US011176803B1

(12) United States Patent
Trundle

(10) Patent No.: US 11,176,803 B1
(45) **Date of Patent: *Nov. 16, 2021**

(54) MISSION CRITICAL SIGNALING FAILOVER IN CLOUD COMPUTING ECOSYSTEM

(71) Applicant: Alarm.com Incorporated, Tysons, VA (US)

(72) Inventor: Stephen Scott Trundle, Falls Church, VA (US)

(73) Assignee: Alarm.com Incorporated, Tysons, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/921,009

(22) Filed: Jul. 6, 2020

Related U.S. Application Data

(63) Continuation of application No. 16/416,348, filed on May 20, 2019, now Pat. No. 10,706,712, which is a (Continued)

(51) Int. Cl.
*G08B 25/00* (2006.01)
*G08B 25/14* (2006.01)
(Continued)

(52) U.S. Cl.
CPC ..... *G08B 25/004* (2013.01); *G08B 25/009* (2013.01); *G08B 25/14* (2013.01); *G08B 29/16* (2013.01); *G08B 29/00* (2013.01)

(58) Field of Classification Search
CPC ..... H04N 21/26208; H04N 21/266; G08B 13/19645; G08B 25/004; G08B 13/19697;
(Continued)

(56) References Cited

U.S. PATENT DOCUMENTS 7,956,735 B2 * 6/2011 Jackson ..... G08B 13/19656 340/506
2002/0147982 A1 * 10/2002 Naidoo ..... G08B 13/19645 725/105

(Continued)

*Primary Examiner* — Mirza F Alam
(74) *Attorney, Agent, or Firm* — Fish & Richardson P.C.

(57) ABSTRACT

Methods and systems, including computer programs encoded on computer storage media, for reducing the likelihood of signaling failover in an alarm system, the method including identifying alarm events detected at monitored properties by monitoring systems that are located at the monitored properties; tracking the ability of a primary application infrastructure to transmit, to a central monitoring station server, the alarm events; detecting disruption in the ability of the primary application infrastructure to transmit the alarm events to the central monitoring station server; based on the detected disruption, enabling a signal transmission switch that switches a path for alarm events from the primary application infrastructure to a secondary application infrastructure, the secondary application infrastructure being an infrastructure operated by a cloud service provider; and based on enablement of the transmission switch, transmitting, by the secondary application infrastructure, at least one alarm event to the central monitoring station server.

20 Claims, 12 Drawing Sheets

Related U.S. Application Data continuation of application No. 15/699,172, filed on Sep. 8, 2017, now Pat. No. 10,339,787, which is a continuation of application No. 15/069,480, filed on Mar. 14, 2016, now Pat. No. 9,761,119.

(60) Provisional application No. 62/132,193, filed on Mar. 12, 2015.

(51) Int. Cl.
*G08B 29/16* (2006.01)
*G08B 29/00* (2006.01)

(58) Field of Classification Search
CPC .... G08B 25/009; G08B 25/008; G08B 29/00; A61B 5/002
See application file for complete search history.

(56) References Cited

U.S. PATENT DOCUMENTS

| | | | | |
|---|---|---|---|---|
| 2008/0129497 | A1* | 6/2008 | Woodard | G08B 25/08 340/540 |
| 2009/0121860 | A1* | 5/2009 | Kimmel | A62C 99/00 340/506 |
| 2010/0122280 | A1* | 5/2010 | Sofos | H04N 7/165 725/25 |
| 2013/0015966 | A1* | 1/2013 | Soomro | G08B 25/004 340/502 |

* cited by examiner

700

| | 702 Property ID | 704 Item ID | 706 Event | 708 Time stamp | 710 Criticality score | 712 User contact information |
|---|---|---|---|---|---|---|
| 714 | 0028 | 4751 | Interior motion sensor alarm | 02/03/16 13:28 | 0.9 | (202) 754-3010 |
| 716 | 1467 | 4752 | Fire alarm | 02/03/16 13:32 | 1.0 | john@smith.com |
| 718 | 0127 | 4753 | Driveway alarm | 02/03/16 13:33 | 0.2 | (202) 752-9836 |
| 720 | 0127 | 4754 | Front door bell | 02/03/16 13:35 | 0.2 | (202) 752-9836 |
| 722 | 2811 | 4755 | CO2 alarm | 02/03/16 15:02 | 0.9 | (182) 9270-0012 |

FIG. 7A

750

| Property ID (702) | Item ID (704) | Event (706) | Time stamp (708) | Criticality score (710) | User contact information (712) |
|---|---|---|---|---|---|
| 0028 (714) | 4751 | Interior motion sensor alarm | 02/03/16 13:28 | 0.9 | (202) 754-3010 |
| 1467 (716) | 4752 | Fire alarm | 02/03/16 13:32 | 1.0 | (202) 752-9836 |
| 2811 (718) | 4755 | CO2 alarm | 02/03/16 15:02 | 0.9 | (182) 9270-0012 |

FIG. 7B

MISSION CRITICAL SIGNALING FAILOVER IN CLOUD COMPUTING ECOSYSTEM

CROSS REFERENCE TO RELATED APPLICATIONS

This application is a continuation of U.S. application Ser. No. 16/416,348, filed May 20, 2019, now allowed, which is a continuation of U.S. application Ser. No. 15/699,172, filed Sep. 8, 2017, now U.S. Pat. No. 10,339,787, issued Jul. 2, 2019, which is a continuation of U.S. application Ser. No. 15/069,480, filed Mar. 14, 2016, now U.S. Pat. No. 9,761,119, issued Sep. 12, 2017, which claims the benefit of U.S. Provisional Application No. 62/132,193, filed Mar. 12, 2015. All of these prior applications are incorporated by reference in their entirety.

TECHNICAL FIELD

This disclosure relates to monitoring technology and, for example, communicating critical monitoring data.

BACKGROUND

Many people equip homes and businesses with alarm systems to provide increased security for their homes and businesses. Alarm systems may include control panels that a person may use to control operation of the alarm system and sensors that monitor for security breaches. In response to an alarm system detecting a security breach, the alarm system may generate an audible alert and, if the alarm system is monitored by a monitoring service, the alarm system may send electronic data to the monitoring service to alert the monitoring service of the security breach.

SUMMARY

Techniques are described for improving the reliability of monitoring (e.g., alarm or security) systems by reducing the likelihood of signaling failover.

In general, one innovative aspect of the subject matter described in this specification can be embodied in methods that include the actions of identifying alarm events detected at monitored properties by monitoring systems that are located at the monitored properties and that include at least one sensor within the monitored properties; tracking the ability of a primary application infrastructure to transmit, to a central monitoring station server, the alarm events detected by the monitoring systems; detecting disruption in the ability of the primary application infrastructure to transmit the alarm events detected by the monitoring systems to the central monitoring station server; based on the detected disruption, enabling a signal transmission switch that switches a path for alarm events detected by the monitoring systems from the primary application infrastructure to a secondary application infrastructure, the secondary application infrastructure being an infrastructure operated by a cloud service provider; and based on enablement of the transmission switch, transmitting, by the secondary application infrastructure, at least one alarm event detected by the monitoring systems to the central monitoring station server.

Other embodiments of this aspect include corresponding computer systems, apparatus, and computer programs recorded on one or more computer storage devices, each configured to perform the actions of the methods. A system of one or more computers can be configured to perform particular operations or actions by virtue of software, firmware, hardware, or any combination thereof installed on the system that in operation may cause the system to perform the actions. One or more computer programs can be configured to perform particular operations or actions by virtue of including instructions that, when executed by data processing apparatus, cause the apparatus to perform the actions.

The foregoing and other embodiments can each optionally include one or more of the following features, alone or in combination. In some implementations detecting disruption in the ability of the primary application infrastructure to transmit the alarm events detected by the monitoring systems to the central monitoring station server comprises exchanging, between the primary application infrastructure and secondary application infrastructure, alarm events received by the primary application infrastructure and secondary application infrastructure; comparing the exchanged alarm events to determine whether the alarm events received by the primary application infrastructure and secondary application infrastructure are the same; and in response to determining that the alarm events received by the primary application infrastructure are not the same as the alarm events received by the secondary application infrastructure, detecting disruption in the ability of the primary application infrastructure to transmit the alarm events detected by the monitoring systems to the central monitoring station server.

In some implementations detecting disruption in the ability of the primary application infrastructure to transmit the alarm events detected by the monitoring systems to the central monitoring station server comprises receiving, at the monitoring systems, acknowledgements from the primary application infrastructure confirming receipt of the alarm events; determining that one or more acknowledgements from the primary application infrastructure have not been received; and in response to determining that one or more acknowledgements from the primary application infrastructure have not been received, detecting disruption in the ability of the primary application infrastructure to transmit the alarm events detected by the monitoring systems to the central monitoring station server.

In some cases detecting disruption in the ability of the primary application infrastructure to transmit the alarm events detected by the monitoring systems to the central monitoring station server comprises detecting disruption in one or more transmission paths for the alarm events between the monitoring systems and the primary application infrastructure.

In some instances detecting disruption in one or more transmission paths for the alarm events between the monitoring systems and the primary application infrastructure comprises monitoring, by the secondary application infrastructure, the primary application infrastructure.

In some implementations detecting disruption in one or more transmission paths for the alarm events between the monitoring systems and the primary application infrastructure comprises detecting one or more of (i) a transmission delay in one or more transmission paths for the alarm events between the monitoring systems and the primary application infrastructure, and (ii) that one or more transmissions of the alarm events to the primary application structure is below an expected threshold.

In further implementations detecting that one or more transmissions of the alarm events to the primary application structure is below an expected threshold comprises detecting that one or more transmission of the alarm events is incomplete.

In some cases detecting disruption in one or more transmission paths for the alarm events between the monitoring systems and the primary application infrastructure comprises detecting that a transmission latency of one or more of the alarm events is above an expected threshold.

In further cases detecting disruption in the ability of the primary application infrastructure to transmit the alarm events detected by the monitoring systems to the central monitoring station server comprises detecting disruption at the primary application infrastructure.

In some implementations detecting disruption at the primary application infrastructure comprises detecting disruption at the primary application infrastructure by the secondary application server.

In further implementations the secondary application infrastructure monitors data transmitted to a primary signaling application at the primary application infrastructure from the monitoring systems, comprising performing a recursive comparison between alarm events transmitted to the secondary application infrastructure and alarm events simultaneously transmitted to the primary application infrastructure.

In some cases detecting disruption in the ability of the primary application infrastructure to transmit the alarm events detected by the monitoring systems to the central monitoring station server comprises detecting disruption in a transmission path between the primary application infrastructure and the central monitoring station server.

In some implementations the signal transmission switch is operated by an operator of the primary application infrastructure, wherein the operator monitors connections between the monitoring systems, primary application infrastructure and the central monitoring station server.

In some cases the signal transmission switch comprises an automated computer-implemented protocol at the central monitoring station, wherein, in response to the detected disruption, the automated computer-implemented protocol terminates a first access port between the primary application infrastructure and the central monitoring station server and establishes a second access port between the secondary application infrastructure and the central monitoring station server.

In some implementations the signal transmission switch comprises a controller, wherein, in response to the detected disruption, the controller initiates, at the central monitoring station server, a failover data transmission process from the secondary application infrastructure, comprising receiving, by the central monitoring station server, alarm events from the primary application infrastructure and secondary application infrastructure; comparing the received alarm events from the primary application infrastructure and the alarm events from the secondary application infrastructure to determine whether the received alarm events from the primary application infrastructure are deficient; based on determining that the received alarm events from the primary application infrastructure are deficient, initiating, by the central monitoring station server, a file transfer protocol to retrieve a remainder of the alarm events stored on a secondary application infrastructure.

In some cases the method further comprises detecting that the disruption in the ability of the primary application infrastructure to transmit the alarm events detected by the monitoring systems to the central monitoring station server has been rectified; based on the detected rectification, disabling the signal transmission switch; and transmitting alarm events detected by the monitoring systems from the primary application infrastructure to the central monitoring station server.

In some implementations the secondary application infrastructure comprises an application infrastructure with a lower data retention configuration than the primary application infrastructure.

In some implementations the method further comprises transmitting, by the central monitoring station server and to the secondary application infrastructure, alarm event transmission reports from the primary application infrastructure; comparing, by the secondary application infrastructure, the alarm event transmission reports to alarm events stored at the secondary application infrastructure to determine whether the alarm events stored at the secondary application infrastructure were transmitted by the primary application infrastructure; and in response to determining that some or all of the alarm events stored at the secondary application infrastructure were not transmitted by the primary application infrastructure, transmitting missing alarm events to the central monitoring station server.

The subject matter described in this specification can be implemented in particular embodiments so as to realize one or more of the following advantages. A monitoring system implementing mission critical signal failover may achieve higher levels of reliability and security compared to other monitoring systems that do not implement mission critical signal failover. By including a secondary application infrastructure configured to receive and backup critical monitoring data, such as life-critical alarm events, the monitoring system can reduce the likelihood of signaling failover and ensure that critical monitoring data reaches a central monitoring station, enabling appropriate action to be taken in emergency situations. Furthermore, a monitoring system implementing mission critical signal failover is more robust to system disruptions than other monitoring systems that do not implement mission critical signal failover.

The details of one or more implementations are set forth in the accompanying drawings and the description below. Other features will be apparent from the description and drawings, and from the claims.

DESCRIPTION OF DRAWINGS

FIGS. 7A and 7B illustrate example data records.

Like reference numbers and designations in the various drawings indicate like elements.

DETAILED DESCRIPTION

Techniques are described for improving the reliability of monitoring (e.g., alarm or security) systems by reducing the likelihood of signaling failover. In some implementations, cloud-based monitoring (e.g., alarm or security) systems use cloud computing platforms to receive and process monitoring signals transmitted from in-property monitoring system components via cellular, broadband, or plain ordinary telephone service (POTS) channels. In these implementations, the cloud-based monitoring systems may experience disruptions in cloud application service. These disruptions increase the risk that critical (e.g., life critical) information fails to transmit to a central monitoring station when a homeowner is in danger and may require immediate assistance. To reduce the potential risk of disruption, techniques are described to redundantly transmit critical life safety data over a cloud-based network to a secondary application infrastructure to reduce the dependency on a single application infrastructure. Alarm or security systems are examples of critical monitoring appliances, but the techniques described throughout this disclosure may be applied to any type of critical monitoring appliances, such as life-support devices, fire detectors, smoke detectors, etc.

In some implementations, a system detects disruptions in critical alarm data transmissions between an alarm system and a primary application infrastructure. Upon detection, regardless of whether the system is part of an alarm system or not, the system automatically initiates a compensatory signal transmission from a secondary application infrastructure to a central monitoring station. In these implementations, the system redundantly transmits, from a monitored property, critical monitoring data to both primary and secondary cloud application infrastructures. The system also may continuously monitor the critical alarm data transmitted to the primary application infrastructure from a central monitoring system control unit. When the system detects a disruption in the primary application infrastructure, the system may enable a subsequent signal transmission path from the secondary cloud application infrastructure to the central monitoring station using a signal transmission switch to generate and transmit secondary critical monitoring data from the secondary application infrastructure.

Figure 1:
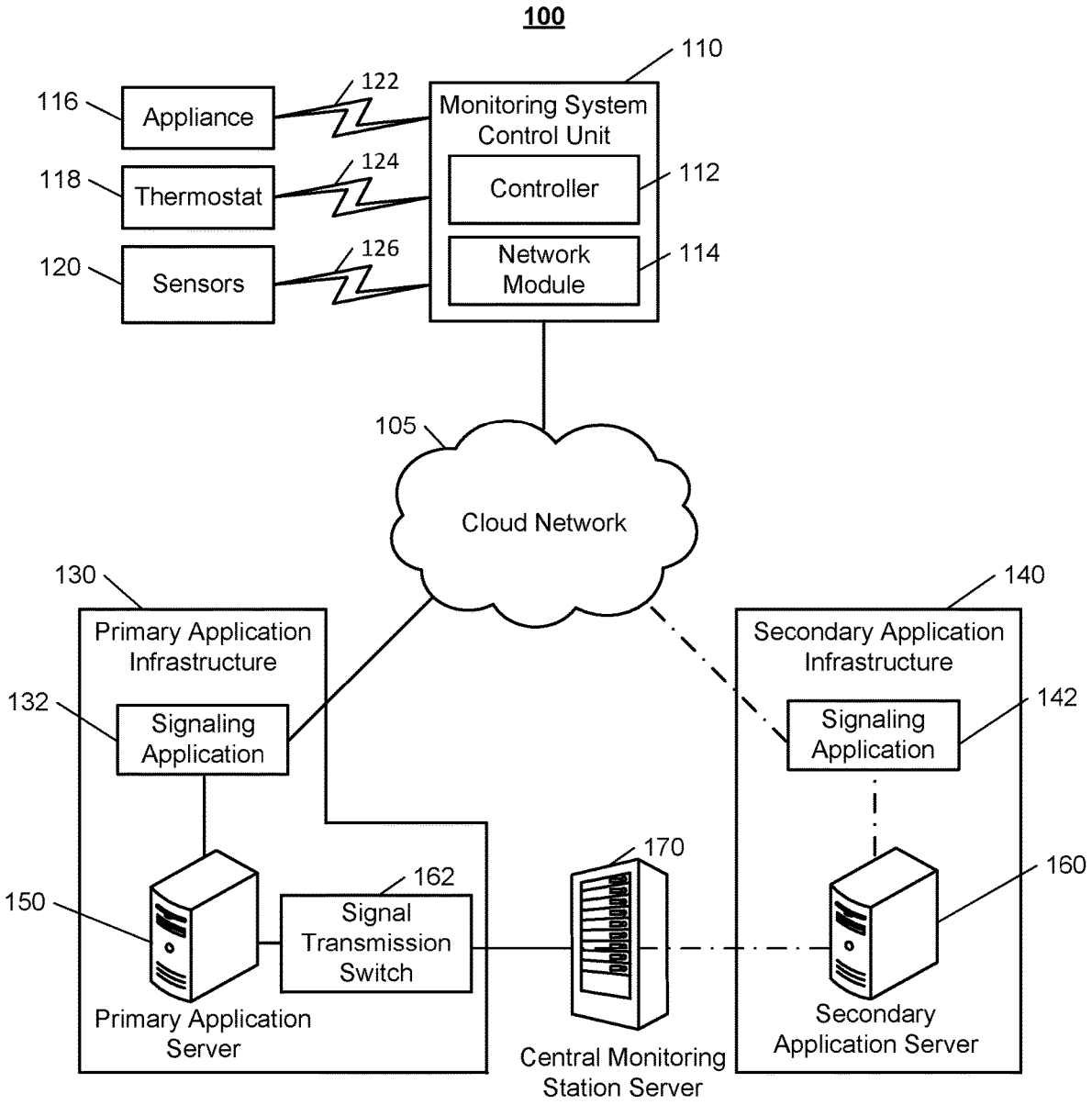
FIG. 1 illustrates an example system.

FIG. 1 illustrates an example of an electronic system 100 configured to provide surveillance and reporting. The electronic system 100 includes a cloud network 105, a monitoring system control unit 110, primary and secondary application infrastructures 130 and 140, primary and secondary application servers 150 and 160, and a central monitoring station server 170. In some examples, the cloud network 105 facilitates communications between the monitoring system control unit 110, the primary and secondary application infrastructures 130 and 140, and the central monitoring station server 170.

The cloud network 105 is configured to enable exchange of electronic communications between devices connected to the cloud network 105. For example, the cloud network 105 may be configured to enable exchange of electronic communications between the monitoring system control unit 110, primary and secondary application infrastructures 130 and 140, and the central monitoring station server 170. The cloud network 105 may include, for example, one or more of the Internet, Wide Area Networks (WANs), Local Area Networks (LANs), analog or digital wired and wireless telephone networks (e.g., a public switched telephone network (PSTN), Integrated Services Digital Network (ISDN), a cellular network, and Digital Subscriber Line (DSL)), radio, television, cable, satellite, or any other delivery or tunneling mechanism for carrying data. Cloud network 105 may include multiple networks or subnetworks, each of which may include, for example, a wired or wireless data pathway. The cloud network 105 may include a circuit-switched network, a packet-switched data network, or any other network able to carry electronic communications (e.g., data or voice communications). For example, the cloud network 105 may include networks based on the Internet protocol (IP), asynchronous transfer mode (ATM), the PSTN, packet-switched networks based on IP, X.25, or Frame Relay, or other comparable technologies and may support voice using, for example, VoIP, or other comparable protocols used for voice communications. The cloud network 105 may include one or more networks that include wireless data channels and wireless voice channels. The cloud network 105 may be a wireless network, a broadband network, or a combination of networks including a wireless network and a broadband network.

The monitoring system control unit 110 includes a controller 112 and a network module 114. The controller 112 is configured to control a monitoring system (e.g., a home alarm or security system) that includes the monitoring system control unit 110. In some examples, the controller 112 may include a processor or other control circuitry configured to execute instructions of a program that controls operation of an alarm system. For example, the controller 112 may be configured to control operation of the network module 114 included in the monitoring system control unit 110.

The monitoring system control unit 110 may be configured to receive input from one or more sensors or detectors 120. For example, the monitoring system control unit 110 may be configured to receive input from multiple sensors 120. The sensors 120 may include a contact sensor, a motion sensor, a glass break sensor, or any other type of sensor included in an alarm system or a security system. The sensors 120 may also include an environmental sensor, such as a temperature sensor, a water sensor, a rain sensor, a wind sensor, a light sensor, a smoke detector, a carbon monoxide detector, an air quality sensor, etc. The sensors 120 further may include a health monitoring sensor, such as a prescription bottle sensor that monitors taking of prescriptions, a blood pressure sensor, a blood sugar sensor, a bed mat configured to sense presence of liquid (e.g., bodily fluids) on the bed mat, etc. In some examples, the sensors may include a radio-frequency identification (RFID) sensor that identifies a particular article that includes a pre-assigned RFID tag. In addition, the sensors 120 may include a video/photographic camera or other type of optical sensing device configured to capture images and may include an energy consumption sensor for appliances and devices in a property monitored by the monitoring system.

The monitoring system control unit 110 communicates with modules 116 and 118 and sensors 120 to perform system monitoring and control. The module 116 is connected to one or more appliances, is configured to monitor activity of the one or more appliances, and is configured to control operation of the one or more appliances. The module 116 may directly measure activity of the one or more appliances or may estimate activity of the one or more appliances based on detected usage of the one or more appliances. The module 116 may communicate energy monitoring information to the monitoring system control unit 110 and may control the one or more appliances based on the commands received from the monitoring system control unit 110.

The module 118 is connected to a thermostat, is configured to monitor temperature of a temperature regulation system associated with the thermostat, and is configured to control operation of the thermostat. The module 118 may directly measure activity of the temperature regulation system associated with the thermostat or may estimate activity of the temperature regulation system associated with the thermostat based on the detected temperature of the temperature regulation system associated with the thermostat. The module 118 also may determine energy usage information based on the activity, communicate energy monitoring information monitoring system control unit 110, and control the thermostat based on commands received from the monitoring system control unit 110.

The modules 116, 118, and sensors 120 communicate with the controller 112 over communication links 122, 124, and 126, respectively. The communication links 122, 124, and 126 may be a wired or wireless data pathway configured to transmit signals from the modules 116, 118, and sensors 120 to the controller 112. The modules 122, 124, and sensors 120 may continuously transmit sensed values to the controller 112, periodically transmit sensed values to the controller 112, or transmit sensed values to the controller 112 in response to a change in a sensed value.

The network module 114 is a communication device configured to exchange communications over the network 105. The network module 114 may be a wireless communication module configured to exchange wireless communications over the network 105. For example, the network module 114 may be a wireless communication device configured to exchange communications over a wireless data channel and a wireless voice channel. In this example, the network module 114 may transmit alarm data over a wireless data channel and establish a two-way voice communication session over a wireless voice channel. The wireless communication device may include one or more of a GSM module, a radio modem, cellular transmission module, or any type of module configured to exchange communications in one of the following formats: GSM or GPRS, CDMA, EDGE or EGPRS, EV-DO or EVDO, UMTS, or IP.

The network module 114 also may be a wired communication module configured to exchange communications over the network 105 using a wired connection. For instance, the network module 114 may be a modem, a network interface card, or another type of network interface device. The network module 114 may be an Ethernet network card configured to enable the monitoring system control unit 110 to communicate over a local area network and/or the Internet. The network module 114 also may be a voiceband modem configured to enable the alarm panel to communicate over the telephone lines of Plain Old Telephone Systems (POTS).

The primary application infrastructure 130 includes a signaling application 132, a primary application server 150, and a signal transmission switch 162. The signaling application 132 is configured to receive all monitoring information (e.g., alarm events and other non-alarm events) through data transmissions from the monitoring system control unit 110. In some examples, the signaling application 132 may include a processor or other control circuitry configured to execute instructions of a program that receives data transmissions from an alarm system through a network connection. In these examples, the signaling application 132 may be configured to receive monitoring data indicating an alarm event has recently taken place in a property where the monitoring system control unit 110 may be located. For example, the signaling application 132 may receive monitoring data, such as sets of activity logs from sensors, detectors, or devices connected within the property. The signaling application 132 may be configured to operate on the primary application server 150, which stores and analyzes the monitoring data for determining appropriate responses to an alarm event.

The signaling application 132 receives all monitoring data generated by the monitoring system control unit 110 including alarm signal data that are both identified as critical and non-critical. The signaling application 132 also enables the user to review monitoring data (e.g., through a mobile application, web interface, etc.), allows the user to receive alert information, view reports about the property, control devices in the property, perform analytics on the generated monitoring data, and coordinate monitoring data generation within the monitoring system control unit 110, such as determining which sensors within the property triggered an alarm event. The signaling application 132 also processes video and image feeds of the property and collects daily information about usage patterns from connected appliances and thermostats.

In some implementations, the signaling application 132 may determine whether monitoring data received from the monitoring system control unit 110 is actually critical monitoring data by identifying life-critical monitoring data based on specific alarm events. For example, the signaling application 132 may identify the monitoring data from a fire alarm event to be life-critical based on its severity to the property and the user, but may identify monitoring events that include general usage patterns as non-critical. In such instances, monitoring data may be identified as critical or non-critical to the primary application server 150 to prioritize actions based on the presence of life-critical information. For instance, the signaling application 132 may track the source of the transmitted monitoring data to determine its significance. For example, if the transmitted monitoring data is generated from fire detector sensors, the signaling application 132 may identify it as "critical" based on the probability that the alarm event was triggered by a fire in the property where the monitoring system control unit 110 is located. Also, the signaling application 132 may identify intrusion detection events, carbon monoxide sensor events, and other events that warrant sounding a siren at the monitored property as critical events.

The primary application server 150 is an electronic device configured to provide monitoring services by exchanging electronic communications with the monitoring system control unit 110 via the signaling application 132, and the central monitoring station server 170 over the cloud network 105. For example, the primary application server 150 may be configured to receive monitoring data generated and transmitted by the monitoring system control unit 110 through the signaling application 132. In this example, the signaling application 132 operates within the primary application server 150 and exchanges electronic communications with the network module 114 included in the monitoring system control unit 110 to receive information regarding events (e.g., alarm events) detected by the monitoring system control unit 110.

The secondary application infrastructure 140 includes a signaling application 142 and a secondary application server 160. Compared to the signaling application 132, which receives all monitoring data generated by the monitoring system control unit 110, the signaling application 142 is configured to only receive critical monitoring information (e.g., life-critical alarm events) through data transmissions from the monitoring system control unit 110 as a secondary resource to the signaling application 132 of the primary application infrastructure 130. In some examples, the signaling application 142 may include a processor or other control circuitry configured to execute instructions of a program in response to disruptions in data transmissions from an alarm system through a network connection to the signaling application 132. In these examples, the signaling application 142 may be configured to continuously monitor the activity of the signaling application 132 to ensure that monitoring data indicating an alarm event within a property where the monitoring system control unit 110 is located is properly transmitted from the network module 114 to the signaling application 132. For example, the signaling application 142 may detect an incomplete monitoring data transmission to the signaling application 132 resulting from a network connection failure. The signaling application 142 may subsequently execute instructions to enable a secondary data transmission path with the network module 114 to receive critical monitoring data from the monitoring system control unit 110 through the cloud network 105.

In some implementations, the signaling application 142 only receives monitoring data identified by the signaling application 132 or the monitoring system control unit 110 as critical monitoring data. For instance, critical monitoring data may only include basic information from specific life-threatening alarm events (e.g., fire alarm, carbon monoxide alarm, security breach alarm) that are needed to transmit the monitoring data to the central monitoring station 170. For example, such basic information may include property identification, contact information for the user, or other information needed to investigate and dispatch emergency services to the property.

In some implementations, the monitoring system control unit 110 may transmit critical monitoring data to the secondary application infrastructure 140 in parallel with the primary application infrastructure 130. For example, the monitoring data generated from an alarm event may be replicated by the controller 112 and transmitted to the signaling applications 132 and 142, respectively, by the networking module 114 over the cloud network 105. In such an example, data transmitted to the signaling application 142 may only be generated as an emergency backup to the data transmitted to the signaling application 132. For instance, the signaling application 142 may have a lower data retention configuration than the signaling application 132 to prevent unnecessary replication of the critical monitoring data within the secondary application infrastructure 140.

In some examples, the secondary application infrastructure 140 may only receive compensatory monitoring data in response a partial or total failure in data transmission process between the network module 114 and the signaling application 132. In such examples, the signaling application 142 may continuously monitor the data integrity of the critical monitoring data transmitted to the signaling application 132. For instance, the signaling application 142 may compare the alarm events processed by the signaling application 132 to determine whether the monitoring data generation processes within the monitoring system control unit 110 and the signaling application 132 adequately match the monitoring data received by the signaling application 142. The signaling application 142 may determine that there was a partial or total failure in data transmission process by analyzing specific attributes of the monitoring data (e.g., transmission package size, identifiers of alarm events, time logs of alarm triggers, latency between subsequent transmissions, etc.) to determine whether the signaling application 132 sufficiently received the monitoring data and communicated it to a central station. In some examples, after determining that the transmission to the signaling application 132 was insufficient, the signaling application 142 may submit a compensatory signal transmission request to the network module 114 of the monitoring system control unit 110 to receive a secondary transmission of the monitoring data over cloud network 105. In these examples, the signaling application 142 may use the identifiers associated with the alarm events to identify segments of the monitoring data that has been successfully transmitted to the signaling application 132, and other segments that were insufficiently transmitted and require a compensatory transmission to the signaling application 142.

In some instances, the signaling application 142 may continuously monitor the critical monitoring data generated by the monitoring system control unit 110 directly to determine whether there may be disruptions within the property where the monitoring system control unit 110 may be located. For example, an alarm unit may be unable to transmit sensor data to the signaling application 132 due to an external power failure preventing the network module 114 from connecting to the cloud network 105. In such an example, the signaling application 142 may subsequently determine a disruption in the critical alarm signal generation at the property.

The secondary application server 160 is an electronic device configured to provide backup monitoring services to the primary application server 150 by exchanging electronic communications with the monitoring system control unit 110 and the central monitoring station 170 over cloud network 105. For example, the secondary application server 160 may be configured to monitor events (e.g., alarm events) transmitted to the primary application server 150 from the monitoring system control unit 110 and receive a subsequent or duplicative set of events transmitted from the monitoring system control unit 110. In this example, the secondary application server 160 may exchange electronic communications with both the network module 114 in the monitoring system control unit 110 and the signaling application 132 of the primary application infrastructure 130. The secondary application server 160 may monitor information regarding events (e.g., alarm events) transmitted to the primary application server 150 and receive secondary backup information regarding events detected by the monitoring system control unit 110.

The central monitoring station server 170 is an electronic device configured to observe alarm monitoring service by exchanging communications with the monitoring system control unit 110, the primary application server 150, and the secondary application server 160 over the cloud network 105. For example, the central monitoring station server 170 may survey alarm data of the property based on the data generated by the monitoring system control unit 110. The central monitoring station server 170 may use the alarm data to tailor a response to a detected alarm event to dispatch emergency assistance service to the property.

In some implementations, the transmissions from the primary application server 150 and the secondary application server 160 may be coordinated and monitoring by one or more central monitoring station servers. For example, the primary and secondary application servers 150 and 160, respectively, may transmit monitoring data to different central monitoring station servers based on various criteria such as the location of the property generating the alarm event and distance between the property generating the alarm event and the nearest central monitoring station server 170.

The signal transmission switch 162 is configured to the primary application server 150 to control monitoring data transmission to the central monitoring station server 170. For example, the signal transmission switch 162 controls whether critical data (e.g., alarms) detected at monitored properties is transmitted to the central station server 170 from the primary application infrastructure 130 or the secondary application infrastructure 140. In this example, the signal transmission switch 162 typically controls the primary application infrastructure 130 to communicate critical data with the central station server 170. However, if the primary application infrastructure 130 malfunctions, the signal transmission switch 162 is able to divert the signaling path to the central station server 170 to the secondary application infrastructure 140. Because the secondary application infrastructure 140 has access to critical data, the secondary application infrastructure 140 is able to maintain critical data flowing to the central station server 170 in the event of malfunction of the primary application infrastructure 130. Although critical data is continued to be processed, because the secondary application infrastructure 140 is a stripped down version of the primary application infrastructure 130 that only processes critical data, other non-critical aspects of the monitoring system 100 (e.g., processing of general monitoring data, video processing, access through user devices, etc.) do not restore until the primary application infrastructure 130 becomes operational. In this regard, the secondary application infrastructure 140 may offer a relatively low cost solution to maintain life-critical operations of the monitoring system 100, even in the event of a rare instance in which the primary application infrastructure 130 fails.

In some implementations, the signal transmission switch 162 may function as a manual failover switch within the primary application server 150. For example, the signal transmission switch 162 may be a user interface button presented to an operator of primary application server 150 that enables data transmission from the secondary application server 160 to the central monitoring station server 170. In such examples, the secondary application server 160 provides no monitoring data transmissions to the central monitoring station server 170 until the signal transmission switch 162 is activated by the operator. For instance, the operator may determine that a disruption in the signaling application 132 is preventing or impairing the critical monitoring data transmission to the central monitoring station server 170. The operator may then manually activate the signal transmission switch 162, which allows transmission of the backup data from the secondary application server 160 to the appropriate central monitoring station server to receive critical monitoring data.

In some implementations, the signal transmission switch 162 may be an automated computer-implemented protocol within the primary application server 150 that terminates an access port with the central monitoring station 170 and establishes a different access port between the secondary application server 160 and the appropriate central monitoring station 170 in response to a detected disruption. In some instances, the signal transmission switch 162 may modulate a single access port between the central monitoring station server 170 and either of the primary application server 150 and secondary application server 160, respectively, based on specified configuration settings. In such instances, the configuration settings for the primary application server 150 may change in response to a detected disruption in the signal transmission to the primary application server 150. In other implementations, the signal transmission switch 162 may modulate a single access port between the central monitoring station server and either of the primary application server 150 and secondary application server 160, respectively, based on specified configuration settings. In such an instance, the configuration settings for the secondary application server 160 may change in response to a detected disruption in the signal transmission to the primary application server 150.

In some implementations, the signal transmission switch 162 may be a controller that includes hardware configurations for the primary application server 150 that allow it to initiate a failover data transmission process from the secondary application server 160 upon detecting a disruption in the primary application server 150. In these implementations, the secondary application server 160 may monitor the communications to the central monitoring station server 170 to ensure that all critical monitoring data is adequately transmitted from the primary application server 150 to the central monitoring station server 170. In such instances, the secondary application server 160 may cross-check the received monitoring data sent to the central monitoring station server 170 against the critical monitoring data received by the secondary application server 160 from the monitoring system control unit 110. In addition, the central monitoring station server 170 may communicate transmission reports from the primary application server 150 to the secondary application server 160 to avoid duplicate transmissions from the primary and secondary application servers 150 and 160, respectively, to the central monitoring station server 170. The secondary application server 160 may then check the transmission report from the central monitoring station server 170 to ensure that all critical monitoring data has been transmitted by the primary application server 150. The secondary application server 160 may transmit missing critical monitoring data to the central monitoring station server 170 until the primary application server 150 resumes control by enabling the signal transmission switch 162.

In some implementations, the secondary application server 160 may receive concurrent critical monitoring data transmissions from the monitoring system control unit 110 as the primary application server 150. In such implementations, the primary application server 150 and the secondary application server 160 may periodically exchange communications and the secondary application server 160 may compare the transmission the primary application server 150 to its received critical monitoring data. For instance, if the secondary application server 160 determines that the primary application server 150 is missing critical monitoring data, the secondary application server 160 may take over with transmissions to the central monitoring station server 170 to provide the remainder of the critical monitoring data stored on the secondary application server 160.

In some implementations, the signal transmission switch 162 may be modulated by the monitoring system control unit 110 based on its communications with the signaling application 132 and the signaling application 142. For example, if the monitoring system control unit 110 fails to receive an acknowledgement from the signaling application 132 in response to a critical monitoring data transmission, then the monitoring system control unit 110 may flag the transmission, disable the signal transmission switch 162, and initiate a connection with the signaling application 142 to transmit the critical monitoring data to the central monitoring station server 170.

In some implementations, the signal transmission switch 162 may be modulated by the central monitoring station server 170 based on the volume of communication from the primary application server 150. For example, the central monitoring station server 170 may temporarily disable the signal transmission switch 162 if the monitoring data transmitted from the primary application server 150 is less than the volume anticipated. In such examples, the central monitoring stations server 170 may determine the anticipated transmission volume by comparing the received monitoring data to a repository of previous monitoring data transmission from similar alarm events. A central monitoring station 170 may then establish a connection with the secondary application server 160 to receive the remainder of the monitoring data from the secondary application server 160 and determine whether a malfunction occurred and critical events were missed or whether the dip in volume was an atypical result.

Figure 2:
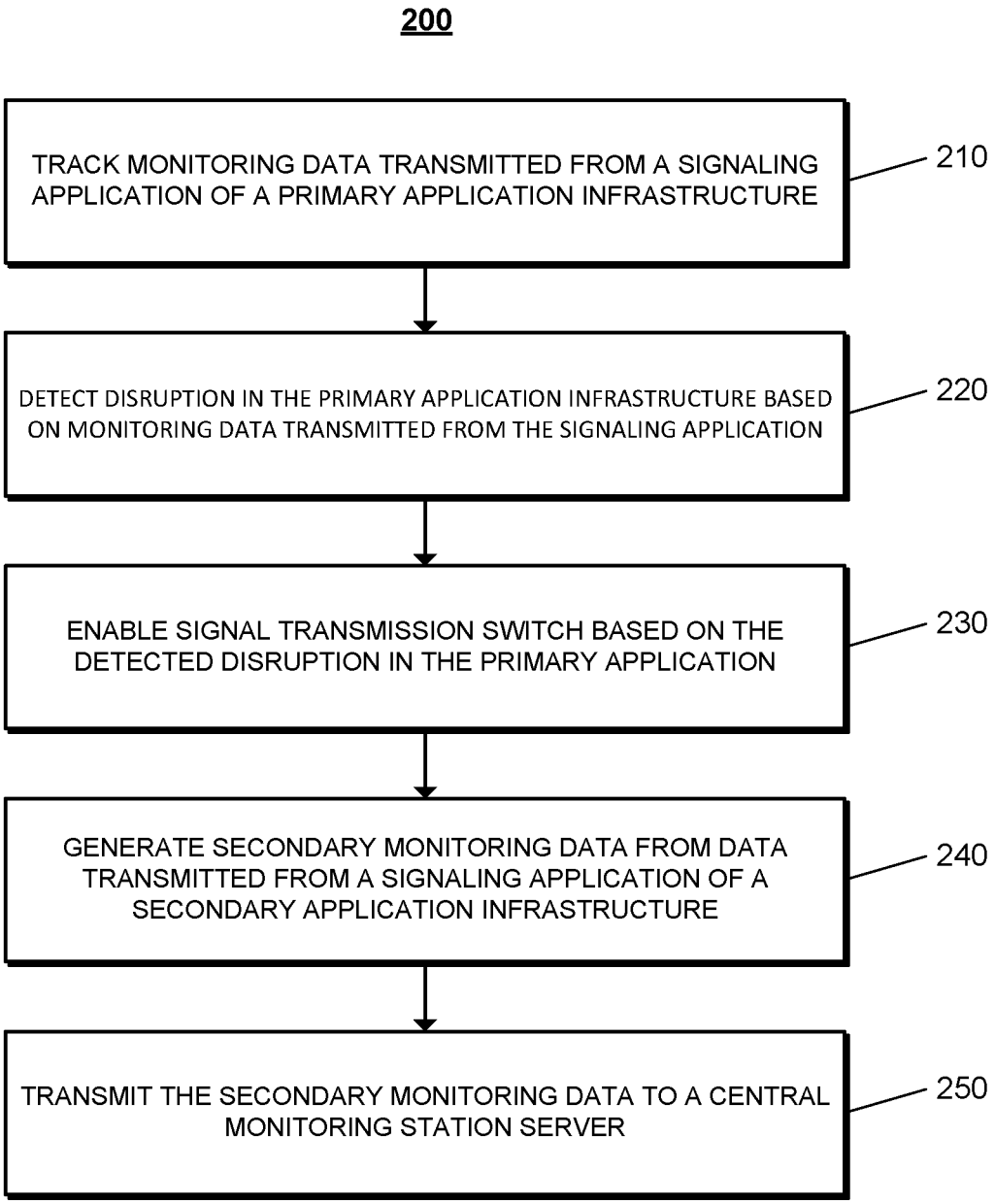
FIG. 2 is a flow chart of an example process for transmitting critical monitoring data to a central monitoring station server.

FIG. 2 is a flow chart of an example process for transmitting example monitoring data to a central network operation center using a secondary application server. The operations of the example process 200 are described generally as being performed by the system 100. The operations of the example process 200 may be performed by one of the components of the system 100 (e.g., one of the primary and secondary application servers 150 and 160) or may be performed by any combination of the components of the system 100 (e.g., a combination of the primary and secondary application servers 150 and 160). In some implementations, operations of the example process 200 may be performed by one or more processors included in one or more electronic devices.

Briefly, the system 100 tracks monitoring data transmitted from a signaling application of a primary application infrastructure (210). Based on the monitoring data transmitted from the signaling application, the system 100 detects disruption in the signaling application of the primary application infrastructure (220). Based on the detected disruption in the signaling application, the system 100 enables a signal transmission switch (230). The system 100 generates secondary monitoring data from data transmitted from a signaling application of a secondary application infrastructure (240). The system 100 transmits the secondary alarm signal to a central monitoring station server (250).

The example process 200 begins when the system 100 tracks monitoring data transmitted from a signaling application of a primary application infrastructure (210). In some instances, the monitoring data includes receiving an indication from the monitoring system control unit 110 associated with the alarm system. For example, the alarm system may receive an indication from one or more door sensors, window sensors, temperature sensors, humidity sensors, noise sensors, motion sensors, or other sensors indicating that an alarm event has occurred. In some implementations, the detection of the alarm event may be performed by a control panel associated with the alarm system, where the various sensors of the alarm system may be connected to the control panel using one or more wired or wireless connections.

In some instances, detecting an alarm event at the property monitored by the alarm system may occur through other mechanisms. For example, a user associated with the property may notify the system 100 of an alarm event. Notifying the system of an alarm event may be performed, for example, by indicating that an alarm event has occurred at a control panel of the alarm system, or by indicating that an alarm event has occurred using a surveillance application loaded on a mobile device associated with the alarm system monitoring the property.

The system 100 detects disruption in the primary application infrastructure based on monitoring data transmitted from the signaling application (220). For example, the detected disruption may be a transmission delay from the monitoring system control unit 110 to the signaling application 132. In some instances, this transmission delay may be caused by network or power interference that prevents the network module 114 of the monitoring system control unit from contacting the signaling application 132. In addition, the transmission delay may be caused by reduced bandwidth capacity in the signaling application 132 due an increased signal load from other alarm systems. For example, a local seasonal storm may cause a sharp increase in alarm events within a particular location, which may subsequently increase signal transmission to the primary application infrastructure 130 that connects alarm systems within one location.

In another example, the detected disruption may be an indication that the transmitted alarm signal is below to an expected threshold for a particular alarm event. For instance, the signaling application 132 may compare the monitoring data from a particular alarm event to a threshold based on monitoring data from prior alarm events with similar characteristics. In this instance, a detected disruption may indicate that the alarm signal was incompletely transmitted to the signaling application 132, indicating that life-critical information necessary for emergency services may be missing and/or corrupted upon transmission.

In another example, the detected disruption may be transmission latency above an expected threshold for a particular alarm event. For instance, the signaling application 132 may receive intermittent monitoring data with a time delay between subsequent transmissions indicative of a poor connection to the cloud network 105. The connection failure may impact the monitoring system control unit in the process of generating and transmitting the monitoring data or the signaling application 132 in receiving and processing the transmitted monitoring data. In such instances, the latency threshold may be a maximum acceptable time delay between transmissions that does not impact the receiving or processing of the monitoring data by the signaling application data 132.

In some implementations, the disruption may be detected by the primary application infrastructure based on monitoring the signaling application 132. In other implementations, the disruption may be detected by the primary application server receiving the transmitted monitoring data from the signaling application. In such implementations, the primary application server 150 may track the data sent by the signaling application 132 and compare the monitoring data received to a repository of prior monitoring data transmissions to determine whether any data disruptions are present within the instant monitoring data transmission. In yet another implementation, the disruption may be detected by the secondary application infrastructure 140, which continuously monitors monitoring data transmitted to the signaling application 132 from the monitoring system control unit. In such implementations, the signaling application 142 may perform a recursive comparison between the monitoring data transmitted to the signaling application 142 and the monitoring data simultaneously transmitted to the signaling application 132. For example, the secondary application infrastructure 140 may determine that the monitoring data transmitted to the signaling application 132 is deficient based on comparing the transmission sizes between the two transmissions.

The system 100 enables a signal transmission switch based on the detected disruption to receive signal data from the secondary application infrastructure (230). In some implementations, the signal transmission switch 162 may be operated by an operator of the cloud network 105 who monitors the connections between the monitoring system control unit 110, the primary application infrastructure 130, and the central monitoring station server 170. For example, an operator located in the central monitoring station may receive a notification of a detected disruption within the signaling application 132 that is preventing or impairing monitoring data transmission to the central monitoring station server 170. The operator may then manually change a configuration in the central monitoring station server to receive monitoring data from the secondary application server 160.

In some implementations, the signal transmission switch 162 may be an automated computer-implemented protocol within the central monitoring station 170 that terminates an access port between the primary application server 150 and establishes a different access port between the secondary application server 160 in response to a detected disruption. In addition, the signal transmission switch 162 may modulate a single access port between the central monitoring station server and either of the primary application server 150 and secondary application server 160, respectively, based on specified configuration settings. In such an instance, the configuration settings for the central monitoring station server may change in response to a detected disruption in the signal transmission to the primary application server 150.

In some examples, the signal transmission switch 162 may be a controller that includes hardware configurations for the central monitoring station server 170 that allow it to initiate a failover data transmission process from the secondary application server 160 upon detecting a disruption in the primary application server 150. In these examples, the central monitoring station server may receive concurrent monitoring data transmissions from the primary application server and the secondary application server and compare the transmission from the primary application server 150 to a threshold. In such an instance, if the monitoring data from the primary application server 150 is deficient, the central monitoring station server 170 may initiation a file transfer protocol to retrieve the remainder of the monitoring data stored on the secondary application server 160.

The system 100 generates secondary monitoring data from the data transmitted from a signaling application of the secondary application infrastructure (240). In some implementations, for example, the secondary monitoring data is generated on the secondary application server in response to a detected disruption in the primary application infrastructure 130. The secondary application server 160 may receive a signal to extract monitoring data from the signaling application 142 of the secondary application infrastructure 140. The monitoring data may be temporarily stored on the secondary application server 160, which may transmit the monitoring data to the central monitoring station server 170 after the signal transmission switch 162 is enabled.

In some implementations, the secondary monitoring data may be generated and communicated directly to the central monitoring station server in response to a detected disruption in the primary application infrastructure 130. For example, the monitoring data may be automatically transmitted from the signaling application 142 of the secondary application infrastructure 140 onto the secondary application server 160, where it may be stored for a certain period of time during the development of an alarm event. The central monitoring station server 170 may subsequently receive the monitoring data from the secondary application server 160. In these examples, the monitoring data is processed on the central monitoring station server 170 to be stored in a repository or sent to emergency dispatch services to respond to an alarm event.

The system 100 transmits the secondary monitoring data to the central monitoring station server (250). In some instances, after detecting a disruption in the primary application infrastructure 130, the system 100 may coordinate a set of responsive actions to transmit monitoring data stored on the secondary application server to the central monitoring station server. For example, the central monitoring station server may create a new entry within a repository for monitoring data transmitted from the secondary application server to be sent to emergency dispatch service. In such an example, the new repository entry may replace a prior repository entry with monitoring data from the primary application server that was subsequently determined to be incomplete, deficient or inaccurate.

In addition, the system 100 may temporarily disable the operation of the primary application server in response to detecting a disruption of the primary application infrastructure to maintain data integrity within the central monitoring station server and conserve network resources that may be allocated to performing other operations. For example, the central monitoring station server 170 may temporary disable network connections with the primary application server and dedicate the extra bandwidth to establishing a stronger network connection with the secondary application server 160 to decrease the time to generate secondary monitoring data.

FIGS. 3A-3D illustrate example processes for transmitting critical monitoring data, e.g., alarm events detected at a monitored property, to a central monitoring station server. As shown in each of FIGS. 3A-3D, a property 10 (e.g., a home) of a user 50 is monitored by an in-home cloud-based monitoring system (e.g., in-home security system) that includes components that are fixed within the property 10. The in-home cloud-based monitoring system includes a control panel 24, a front door sensor 22, a motion sensor 20, and a back door sensor 26. The front door sensor 22 is a contact sensor positioned at a front door of the property 10 and configured to sense whether the front door is in an open position or a closed position. The motion sensor 20 is configured to sense a moving object within the property 10. The back door sensor 26 is a contact sensor positioned at a back door of the property 10 and configured to sense whether the back door is in an open position or a closed position. The in-home cloud-based monitoring system shown in each of FIGS. 3A-3D is merely an example and the monitoring system may include more, or fewer, components and different combinations of sensors, as described above with reference to FIG. 1.

Figure 3A:
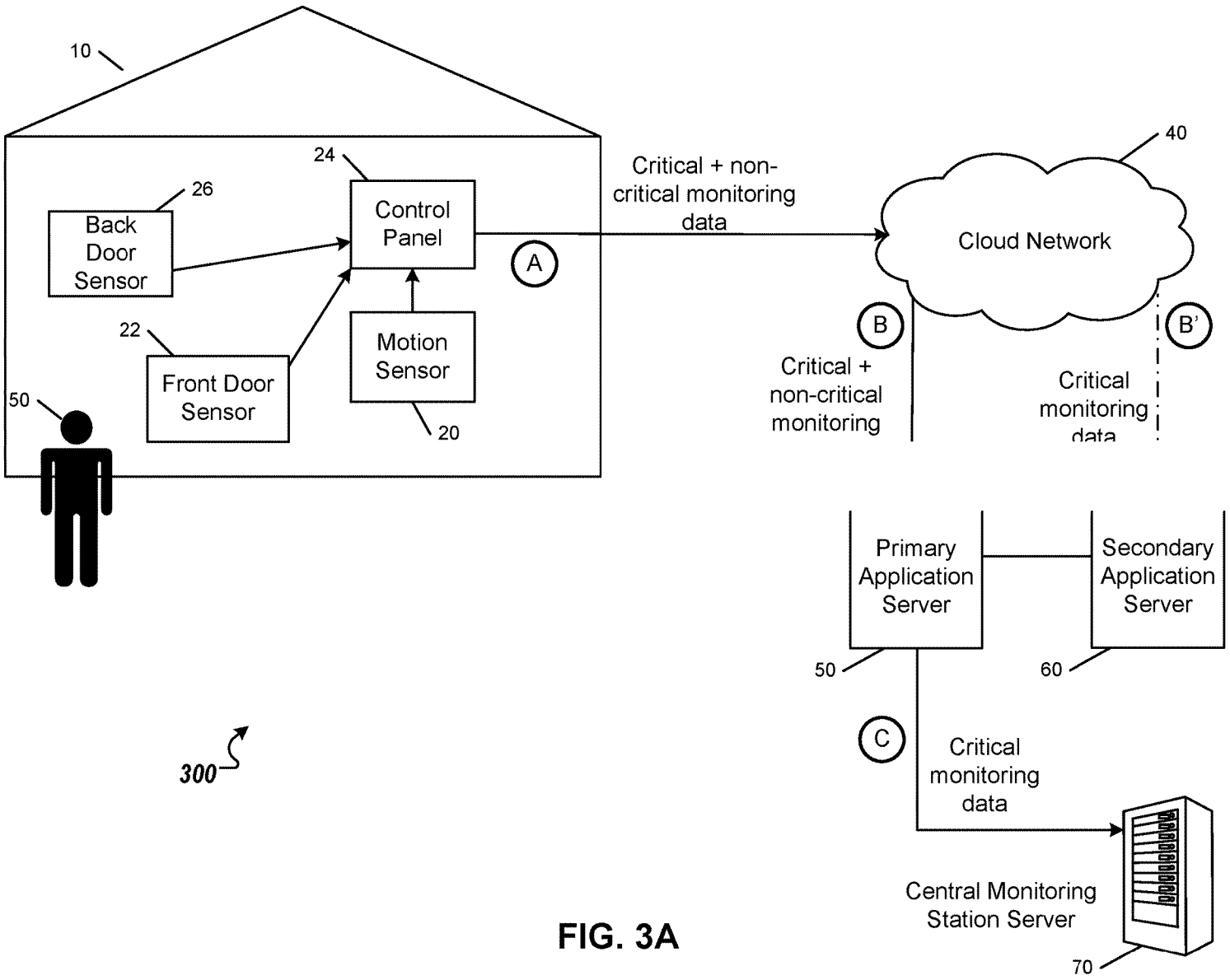
FIGS. 3A-3D illustrate examples of transmitting monitoring data to a central monitoring station server using a secondary application infrastructure.

FIG. 3A illustrates an example process for transmitting critical monitoring data, e.g., alarm events detected at a monitored property 10, to a central monitoring station server using a primary application server. During operation (A), the control panel 24 communicates over a short-range wired or wireless connection with each of the front door sensor 22, the motion sensor 20, and the back door sensor 26 to receive monitoring data descriptive of events detected by the front door sensor 22, the motion sensor 20, and the back door sensor 26. The monitoring data may include critical monitoring data, such as indications of a fire alarm event or carbon dioxide alarm event, and non-critical monitoring data, such as activity logs from sensors connected within the property.

During operation (B), the control panel 24 transmits received monitoring data that is both critical and non-critical monitoring data, e.g., across cloud network 40, to primary application server 50. As described above with reference to FIG. 1, primary application server 50 is configured to receive all monitoring data through data transmissions from the control panel 24. Primary application server 50 is further configured to store and analyze the received monitoring data, for example to identify critical monitoring data and to determine an appropriate response for an alarm event included in the received monitoring data.

Optionally, during operation (B'), control panel 24 may replicate received critical monitoring data and transmit the replicated critical monitoring data across cloud network 40 to secondary application server 60 in parallel with transmitting the received monitoring data to primary application server 50, for example as an emergency back-up. As described above with reference to FIG. 1, secondary application server 60 is configured to only receive critical monitoring data through data transmissions from the control panel 24 as a secondary resource to primary application server 50.

During operation (C), primary application server 50 transmits monitoring data that has been identified as critical monitoring data by the primary application server to central monitoring station server 70. Central monitoring station server 70 receives the critical monitoring data and uses the critical monitoring data to tailor a response to the critical monitoring data, such as dispatching an emergency assistance service to the property 10.

Figure 3B:
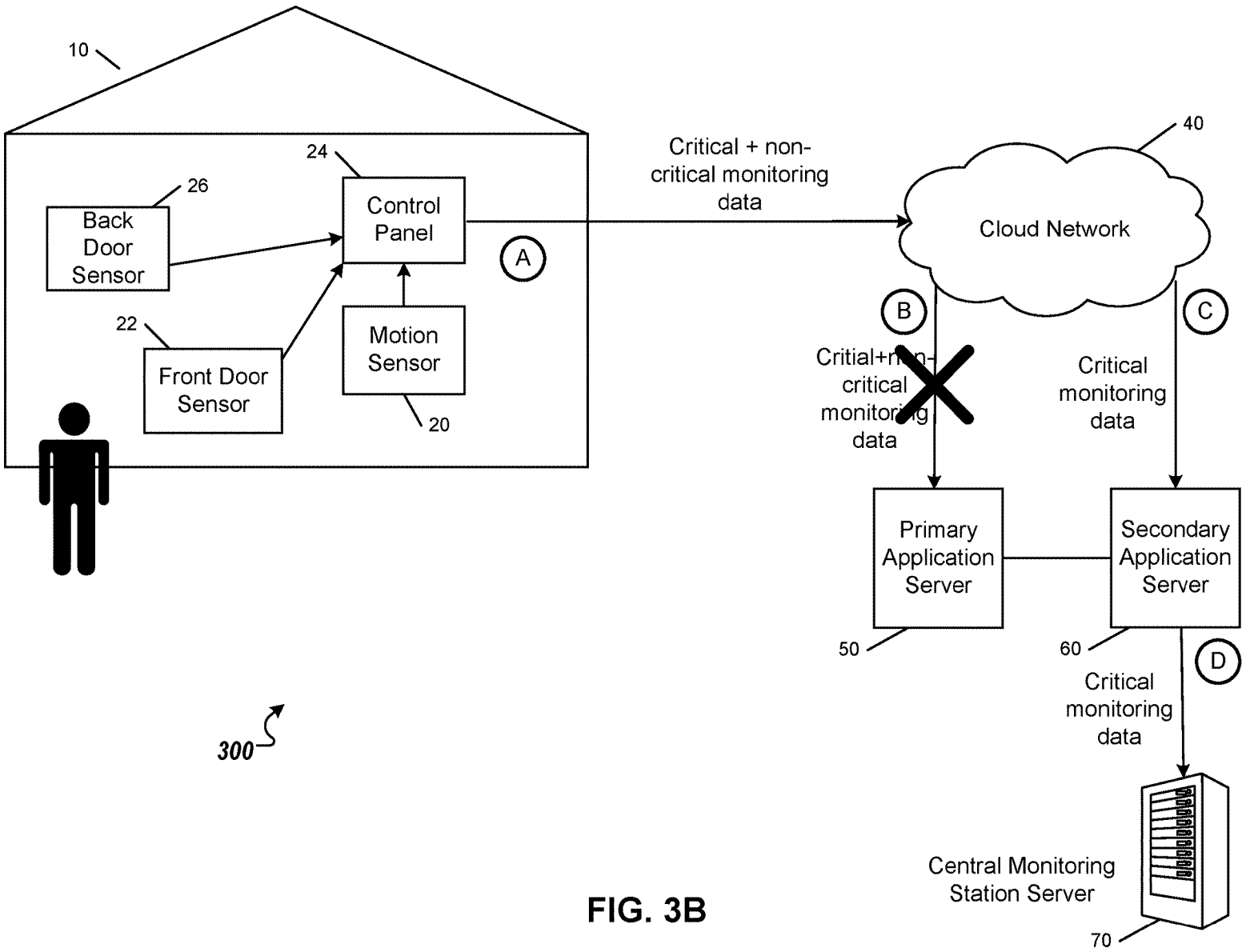

FIG. 3B illustrates an example process for transmitting critical monitoring data e.g., alarm events detected at a monitored property 10, to a central monitoring station server using a secondary application server. During operation (A), the control panel 24 communicates over a short-range wired or wireless connection with each of the front door sensor 22, the motion sensor 20, and the back door sensor 26 to receive monitoring data descriptive of events detected by the front door sensor 22, the motion sensor 20, and the back door sensor 26. The monitoring data may include critical monitoring data, such as indications of a fire alarm event or carbon dioxide alarm event, and non-critical monitoring data, such as activity logs from sensors connected within the property.

During operation (B), the control panel 24 transmits received monitoring data that is both critical and non-critical monitoring data, across cloud network 40 to primary application server 50. Due to disruption in the transmission of the received monitoring data over cloud network 40 to primary application server 50, the transmitted monitoring data may not be properly received by primary application server 50. For example, as described above with reference to FIG. 1, the disruption may include a transmission delay from cloud network 40 to primary application server 50, due, for example, to network connection failure, and resulting in primary application server receiving incomplete monitoring data. As another example, the disruption may include transmission delay from cloud network 40 to primary application server 50, or an unacceptable amount of transmission latency.

As described above with reference to FIG. 3A, in some implementations, during operation (C), control panel 24 may replicate received critical monitoring data and transmit the replicated critical monitoring data across cloud network 40 to secondary application server 60 in parallel with transmitting the received monitoring data to primary application server 50, for example as an emergency back-up.

In some implementations, during operation (C), secondary application server 60 continuously monitors primary application server 50 to ensure that critical monitoring data is properly transmitted over cloud network 40 to primary application server 50, i.e., to ensure the integrity of the critical monitoring data transmitted to primary application server. Upon determining that transmission of critical monitoring data is insufficient, secondary application server submits a request to control panel 24 to receive a secondary transmission of the monitoring data over cloud network 40.

During operation (D), secondary application server 60 transmits received critical monitoring data to central monitoring station server 70. As described above with reference to FIG. 1, a signal transmission switch controls whether the critical monitoring data is transmitted to central monitoring station server 70 from primary application server 50 or secondary application server 60. Central monitoring station server 70 receives the critical monitoring data and uses the critical monitoring data to tailor a response to the critical monitoring data, such as dispatching an emergency assistance service to the property 10.

Figure 3C:
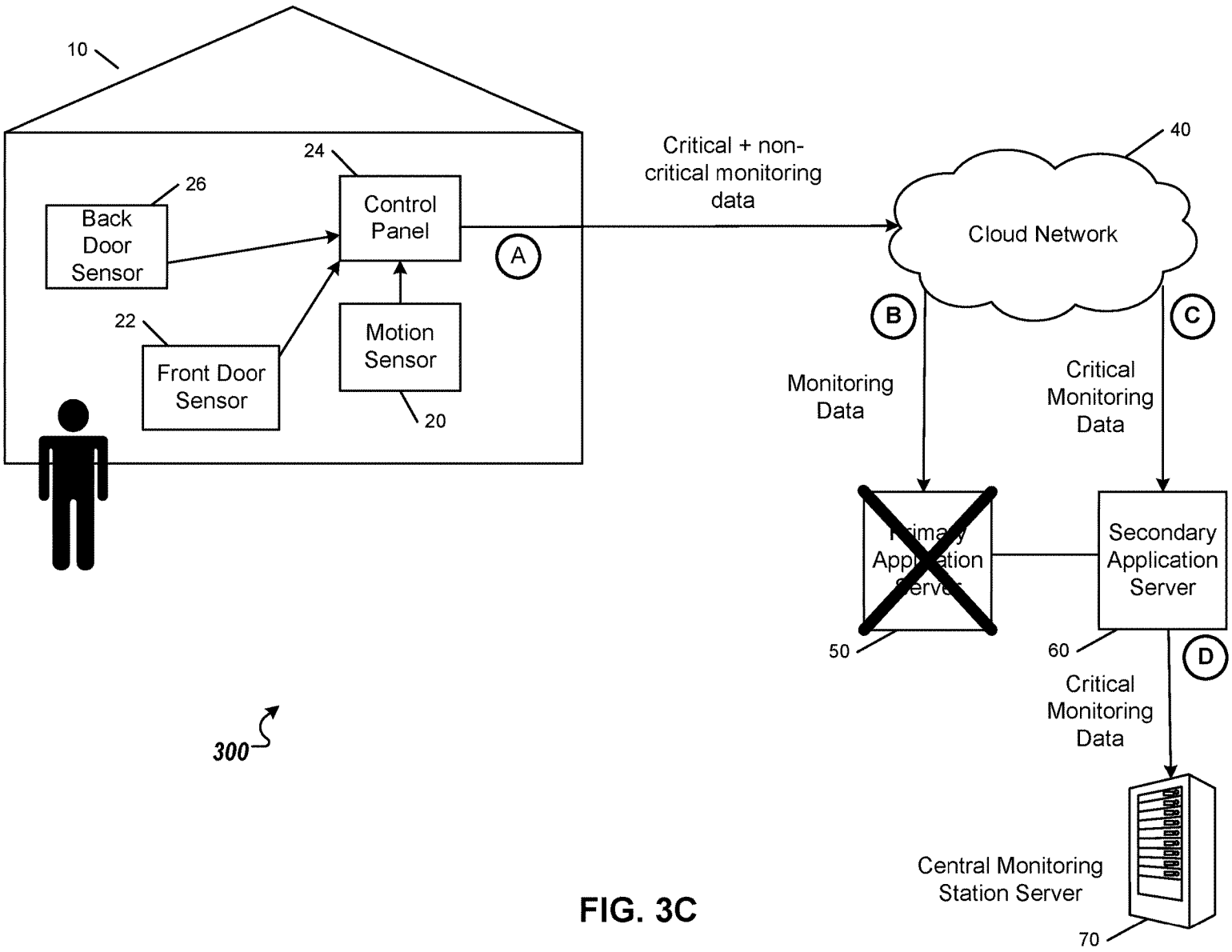

FIG. 3C illustrates an example process for transmitting critical monitoring data, e.g., alarm events detected at a monitored property 10, to a central monitoring station server using a secondary application server. During operation (A), the control panel 24 communicates over a short-range wired or wireless connection with each of the front door sensor 22, the motion sensor 20, and the back door sensor 26 to receive monitoring data descriptive of events detected by the front door sensor 22, the motion sensor 20, and the back door sensor 26. The monitoring data may include critical monitoring data, such as indications of a fire alarm event or carbon dioxide alarm event, and non-critical monitoring data, such as activity logs from sensors connected within the property.

During operation (B), control panel 24 transmits received monitoring data that is both critical and non-critical monitoring data, across cloud network 40 to primary application server 50. Due to disruption at primary application server 50 the transmitted monitoring data may not be received by primary application server 50 or may not be properly processed by primary application server 50, e.g., due to primary application server becoming in operational due to hardware problems or due to server overload.

As described above with reference to FIG. 3A, in some implementations, during operation (C), control panel 24 may replicate received critical monitoring data and transmit the replicated critical monitoring data across cloud network 40 to secondary application server 60 in parallel with transmitting the received monitoring data to primary application server 50, for example as an emergency back-up.

In some implementations, during operation (C), secondary application server 60 continuously monitors primary application server 50 to ensure that critical monitoring data is being received and processed by primary application server 50. Upon determining that primary application server is non-operational or unresponsive, secondary application server submits a request to control panel 24 to receive a secondary transmission of the monitoring data over cloud network 40.

During operation (D), secondary application server 60 transmits received critical monitoring data to central monitoring station server 70. As described above with reference to FIG. 1, a signal transmission switch controls whether the critical monitoring data is transmitted to central monitoring station server 70 from primary application server 50 or secondary application server 60. For example, a signal transmission switch at primary application server 50 may divert the signaling path of critical monitoring data such that critical monitoring data is transmitted from secondary application server 60 to central monitoring station server 70 in response to malfunctions at primary application server 50.

Central monitoring station server 70 receives the critical monitoring data and uses the critical monitoring data to tailor a response to the critical monitoring data, such as dispatching an emergency assistance service to the property 10.

Figure 3D:
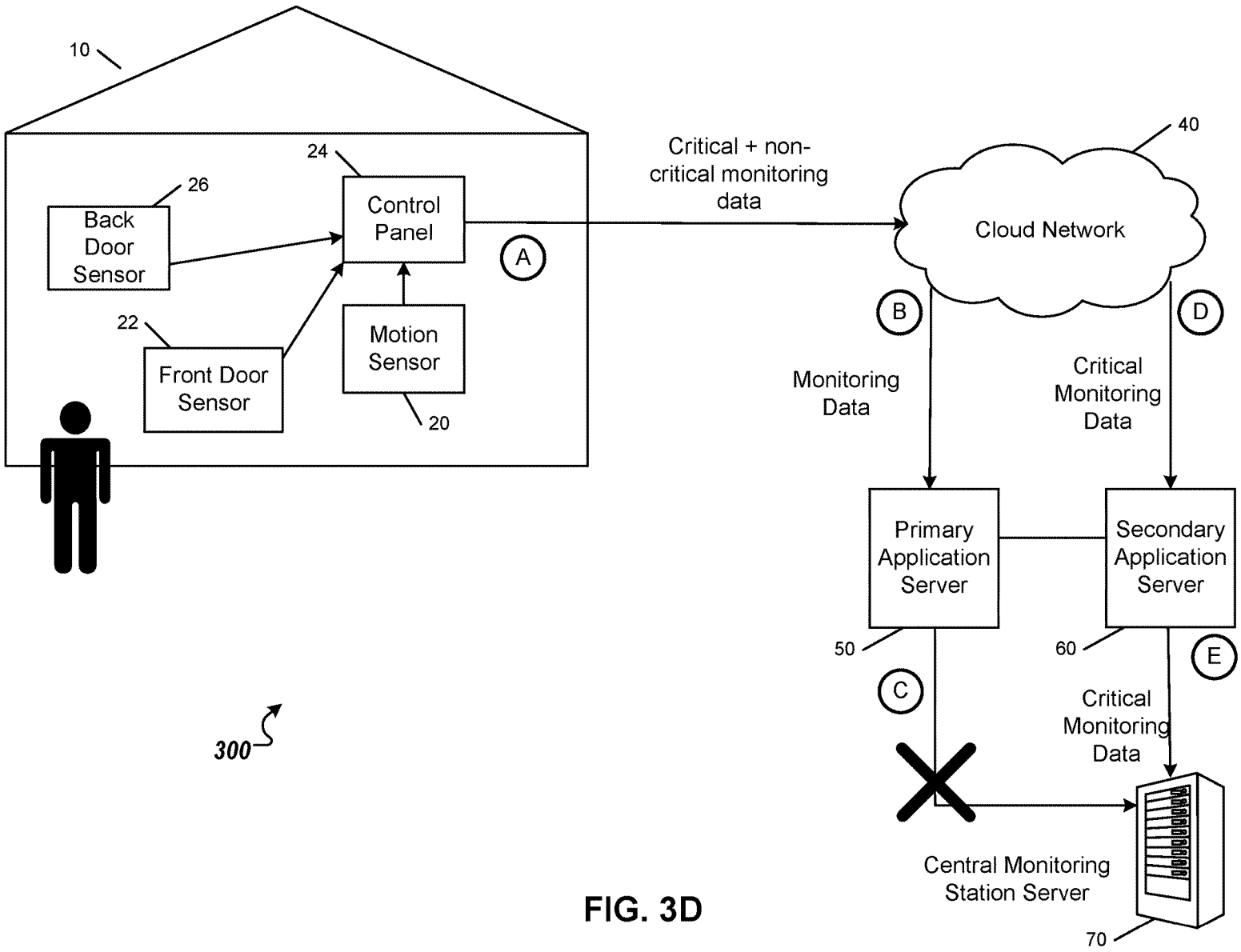

FIG. 3D illustrates an example process for transmitting critical monitoring data, e.g., alarm events detected at a monitored property 10, to a central monitoring station server using a primary application server. During operation (A), the control panel 24 communicates over a short-range wired or wireless connection with each of the front door sensor 22, the motion sensor 20, and the back door sensor 26 to receive monitoring data descriptive of events detected by the front door sensor 22, the motion sensor 20, and the back door sensor 26. The monitoring data may include critical monitoring data, such as indications of a fire alarm event or carbon dioxide alarm event, and non-critical monitoring data, such as activity logs from sensors connected within the property.

During operation (B), the control panel 24 transmits received monitoring data that is both critical and non-critical monitoring data, across cloud network 40 to primary application server 50. As described above with reference to FIG. 1, primary application server 50 is configured to receive all monitoring data through data transmissions from the control panel 24. Primary application server 50 is further configured to store and analyze the received monitoring data, for example to identify critical monitoring data and to determine an appropriate response for an alarm event included in the received monitoring data.

During operation (C), primary application server 50 transmits monitoring data that has been identified as critical monitoring data by the primary application server to central monitoring station server 70. Due to disruption in the transmission of the critical monitoring data over cloud network 40 to central monitoring station server 70, the transmitted critical monitoring data may not be properly received by central monitoring station server 70. For example, the disruption may include a transmission delay from cloud network 40 to central monitoring station server 70, due, for example, to network connection failure, and resulting in central monitoring station server 70 receiving incomplete critical monitoring data. As another example, the disruption may include transmission delay from cloud network 40 to central monitoring station server 70, or an unacceptable amount of transmission latency.

As described above with reference to FIG. 3A, in some implementations, during operation (D), control panel 24 may replicate received critical monitoring data and transmit the replicated critical monitoring data across cloud network 40 to secondary application server 60 in parallel with transmitting the received monitoring data to primary application server 50, for example as an emergency back-up.

In some implementations, during operation (D), secondary application server 60 communicates with primary application server 50 and/or central monitoring station server 70 to ensure that critical monitoring data is properly transmitted over cloud network 40 to central monitoring station server 70. Upon determining that transmission of critical monitoring data is insufficient, either by primary application server 50 or by secondary application server 60, secondary application server 60 submits a request to control panel 24 to receive a secondary transmission of the monitoring data over cloud network 40.

During operation (E), secondary application server 60 transmits received critical monitoring data to central monitoring station server 70. As described above with reference to FIG. 1, a signal transmission switch controls whether the critical monitoring data is transmitted to central monitoring station server 70 from primary application server 50 or secondary application server 60. For example, an operator of the application servers may receive a notification of a detected disruption between the cloud network 40 and central monitoring station server 70. In response to the received notification, the operator of the application servers manually changes a configuration to send monitoring data to the central monitoring station using secondary application server 60. Central monitoring station server 70 receives the critical monitoring data and uses the critical monitoring data to tailor a response to the critical monitoring data, such as dispatching an emergency assistance service to the property 10.

Figure 4:
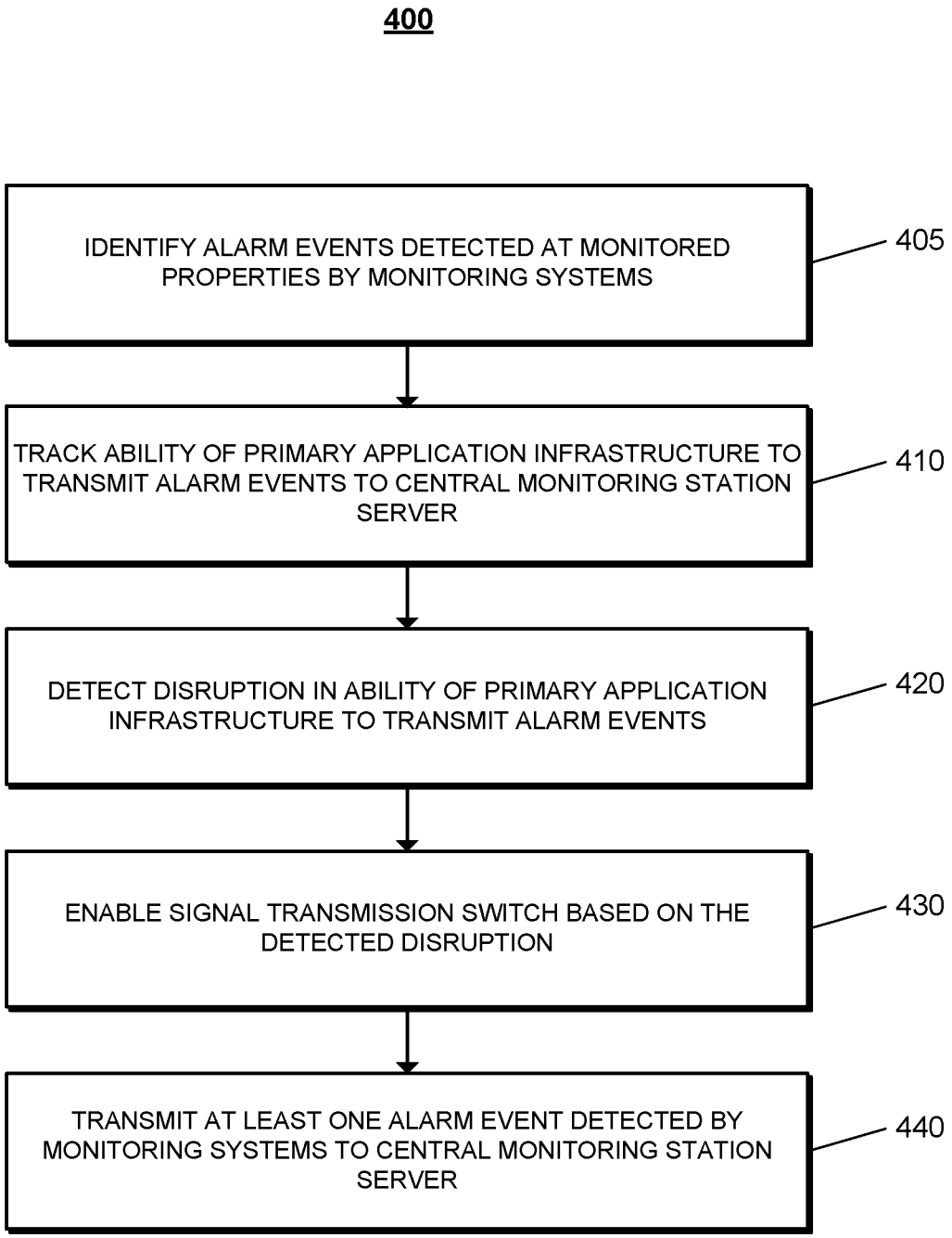
FIG. 4 is a flow chart of an example process for transmitting critical monitoring data to a central monitoring station server.

FIG. 4 is a flow diagram of an example process 400 for transmitting critical monitoring data to a central monitoring station server. The operations of the example process 400 are described generally as being performed by the system 100. The operations of the example process 400 may be performed by one of the components of the system 100 (e.g., one of the primary and secondary application servers 150 and 160) or may be performed by any combination of the components of the system 100 (e.g., a combination of the primary and secondary application servers 150 and 160). In some implementations, operations of the example process 400 may be performed by one or more processors included in one or more electronic devices.

The system identifies alarm events detected at monitored properties by monitoring systems that are located at the monitored properties and that include at least one sensor within the monitored properties (405). For example, the monitored properties may generate monitoring data detected by one or more sensors within the respective monitored properties. The monitoring data includes both critical and non-critical monitoring data. For example, the monitoring data may include critical monitoring data relating to alarm events, such as a fire alarm, and non-critical monitoring data relating to general usage patterns of the monitoring system.

The system tracks the ability of a primary application infrastructure to transmit, to a central monitoring station server, the alarm events detected by the monitoring systems (410). For example, the primary application infrastructure may be configured to receive monitoring data (e.g., alarm events and other non-alarm events) through data transmissions from the monitoring systems and transmit alarm events to the central monitoring station server, as described above with reference to FIG. 1.

The system detects disruption in the ability of the primary application infrastructure to transmit the alarm events detected by the monitoring systems to the central monitoring station server (420). In some implementations the system may detect disruption in the ability of the primary application infrastructure to transmit the alarm events to the central monitoring station server by allowing for communications between the primary and a secondary application infrastructure, where the secondary application infrastructure is an infrastructure operated by a cloud service provider. For example, the primary and secondary application infrastructures may communicate and exchange alarm events that they have respectively received. The system may then compare the exchanged alarm events to determine whether the alarm events received by the primary application infrastructure and secondary application infrastructure are the same. For example, in some cases the primary application infrastructure may not receive all of the alarm events detected at the monitored properties, or the primary application infrastructure may only receive partial alarm events. In response to determining that the alarm events received by the primary application infrastructure are not the same as the alarm events received by the secondary application infrastructure, the system may detect disruption in the ability of the primary application infrastructure to transmit the alarm events detected by the monitoring systems to the central monitoring station server.

In some examples secondary application infrastructure may seek to communicate and exchange alarm events that it has received, but may not receive communication or alarm events from the primary application infrastructure, e.g., within a predetermined threshold period of time. In this example, the system may assume that the primary application infrastructure is non-operational and detect disruption in the ability of the primary application infrastructure to transmit the alarm events detected by the monitoring systems to the central monitoring station server.

In some implementations the system may detect disruption in the ability of the primary application infrastructure to transmit the alarm events detected by the monitoring systems to the central monitoring station server by receiving, at the respective monitoring systems, acknowledgements from the primary application infrastructure confirming receipt of transmitted alarm events. The system may determine that one or more acknowledgements from the primary application infrastructure have not been received, and in response to determining that one or more acknowledgements from the primary application infrastructure have not been received, detect disruption in the ability of the primary application infrastructure to transmit the alarm events detected by the monitoring systems to the central monitoring station server. For example, the system may assume that the primary application infrastructure is non-operation or that there is a disruption in the transmission of the alarm events from the monitoring systems to the primary application infrastructure.

The system may detect disruption in the ability of the primary application infrastructure to transmit the alarm events detected by the monitoring systems to the central monitoring station server by monitoring, by the secondary application infrastructure, the primary application infrastructure. In some implementations the system detects disruption in one or more transmission paths for the alarm events between the monitoring systems and the primary application infrastructure, as illustrated above with reference to FIG. 3B. For example, in some implementations the system may detect that there is a transmission delay in one or more transmission paths for the alarm events between the monitoring systems and the primary application infrastructure, or that one or more transmissions of the alarm events to the primary application structure is below an expected threshold, e.g., transmission of one or more alarm events is incomplete. In further implementations, the system may detect that a transmission latency of one or more of the alarm events is above an expected threshold. Detecting partial or total failure of a monitoring data transmission process between the monitoring systems and the central monitoring station server is described in more detail above with reference to FIG. 1.

In some examples, the system detects disruption at the primary application infrastructure, as illustrated above with reference to FIG. 3C. For example, the system may detect the disruption at the primary application infrastructure using the secondary application server. The secondary application infrastructure may monitor alarm events transmitted to the primary signaling infrastructure from the monitoring systems by performing a recursive comparison between alarm data transmitted to the secondary application infrastructure and by monitoring alarm events simultaneously transmitted to the primary application infrastructure. As described above, the secondary application infrastructure may also detect a disruption at the primary application infrastructure by communicating with and exchanging alarm events with the primary application infrastructure. Detecting partial or total failure of the primary application infrastructure is described in more detail above with reference to FIG. 1.

In further implementations, the system may detect disruption in a transmission path between the primary application infrastructure and the central monitoring station server, as illustrated above with reference to FIG. 3D. For example, the system may detect disruption in a transmission path between the primary application infrastructure and the central monitoring station server using the secondary application server, central monitoring station server or monitoring system. For example, in addition to the methods described above, the central monitoring station may be configured to send acknowledgments to the primary and secondary application infrastructures of alarm events it has received from the primary application infrastructure. If the secondary application infrastructure does not receive an acknowledgement of one or more alarm events that the secondary application infrastructure has received from the monitoring systems, the secondary application infrastructure may determine that there is a communication error between the primary application infrastructure and the central monitoring station server. Detecting partial or total failure of the data transmission process between the primary application infrastructure and the central monitoring station server is described in more detail above with reference to FIG. 1.

Based on the detected disruption, the system enables a signal transmission switch that switches a path for alarm events detected by the monitoring systems from the primary application infrastructure to a secondary application infrastructure (430). The secondary application infrastructure may be an infrastructure that is operated by a cloud service provider. As described above with reference to FIG. 1, the signal transmission switch controls whether critical monitoring data is transmitted to the central monitoring station server from the primary application infrastructure or the secondary application infrastructure. By enabling the signal transmission switch, the system determines to transmit alarm events to the central monitoring station server from the secondary application infrastructure.

In some implementations, the signal transmission switch is operated by an operator of the application infrastructure, wherein the operator monitors connections between the cloud-based monitoring system, primary application infrastructure, and the central monitoring station server. For example, as described above with reference to FIG. 1, the operator may determine that a disruption in the transmission of alarm events to the central monitoring station server is preventing or impairing the critical monitoring data transmission to the central monitoring station server. The operator may then manually enable the signal transmission switch, which allows for the transmission of backup critical monitoring data from the secondary application infrastructure to the central monitoring station server.

In some examples, the signal transmission switch includes an automated computer-implemented protocol at the central monitoring station. For instance, as described above with reference to FIG. 1, in response to detecting disruption, the automated computer-implemented protocol terminates an access port between the primary application infrastructure and the central monitoring station server and establishes a different access port between the secondary application infrastructure and the central monitoring station server.

In further implementations, the signal transmission switch comprises a controller, wherein, in response to detecting disruption, the controller initiates, at the central monitoring station server, a failover data transmission process from the secondary application infrastructure. Initiating a failover data transmission process from a secondary application infrastructure is described in more detail below with reference to FIG. 5.

The system transmits, by the enabled transmission switch, at least one alarm event detected by the monitoring systems to the central monitoring station server (440). The central monitoring station server may use the transmitted alarm event or alarm events to tailor a response to the alarm event, e.g., by dispatching emergency assistance service to a respective property.

In some implementations the system may further track the ability of the secondary application infrastructure to transmit alarm events detected by the monitoring systems to the central monitoring station server. For example, the secondary application infrastructure may also suffer from similar disruptions to that of the primary application server, such as disruption in one or more transmission paths for the alarm events between the monitoring systems and the secondary application infrastructure, disruption at the secondary application infrastructure, or disruption in a transmission path for the alarm events between the secondary application infrastructure and the central station monitoring server. In such cases, the system may create a new emergency backup infrastructure operated by a cloud service provider, e.g., a cloud service provider that is different to the cloud provider for the secondary application infrastructure, to replace the failing secondary application infrastructure.

Figure 5:
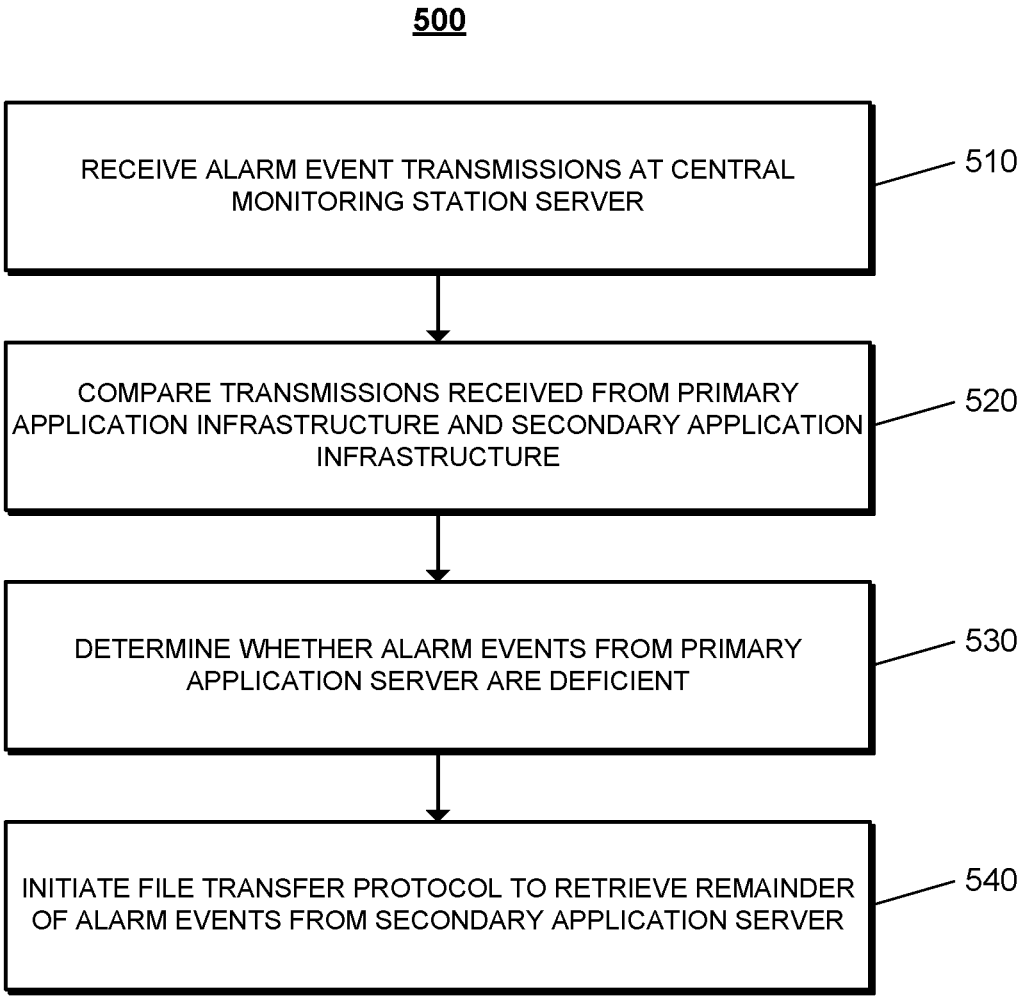
FIG. 5 is a flow chart of an example process for initiating a failover data transmission process from a secondary application infrastructure.

FIG. 5 is a flow diagram of an example process 500 for initialing a failover data transmission process from a secondary application infrastructure. The operations of the example process 500 are described generally as being performed by the system 100. The operations of the example process 500 may be performed by one of the components of the system 100 (e.g., one of the primary and secondary application servers 150 and 160) or may be performed by any combination of the components of the system 100 (e.g., a combination of the primary and secondary application servers 150 and 160). In some implementations, operations of the example process 500 may be performed by one or more processors included in one or more electronic devices.

The system receives, by the central monitoring station server, alarm events from the primary application infrastructure and secondary application infrastructure (510). For example, in some implementations, the central monitoring station server may receive concurrent alarm event transmissions from the primary application infrastructure and the secondary application infrastructure, as described above for example with reference to FIGS. 3A-3D.

The system compares the received alarm events from the primary application infrastructure and the received alarm events from the secondary application infrastructure (520) to determine whether the received alarm events from the primary application infrastructure are deficient (530). For example, the system may determine that alarm events received from the primary application server are incomplete or corrupted. In some implementations the system may determine on or more thresholds to implement when comparing the alarm events. For example, if two alarm events received from the primary and secondary application infrastructures differ only slightly, e.g., both alarm events contain all information needed to alert the emergency services, the system may determine that the alarm event received from the primary application infrastructure is not deficient. In another example, the system may determine that alarm events received from the primary application infrastructure are deficient if they have not been received within a threshold period of time from the corresponding alarm event received from the secondary application infrastructure.

Based on determining that the alarm events received from the primary application server are deficient, the system initiates, by the central monitoring station server, a file transfer protocol to retrieve a remainder of the alarm events stored on the secondary application infrastructure (540). For example, the system may determine that one or more of the alarm events received from the primary application server are incomplete and may initiate a file transfer protocol to retrieve the missing alarm events. As another example, the system may determine that one or more of the alarm events are corrupted and may initiate a file transfer protocol to retrieve the corrupted data in an uncorrupted form.

Figure 6:
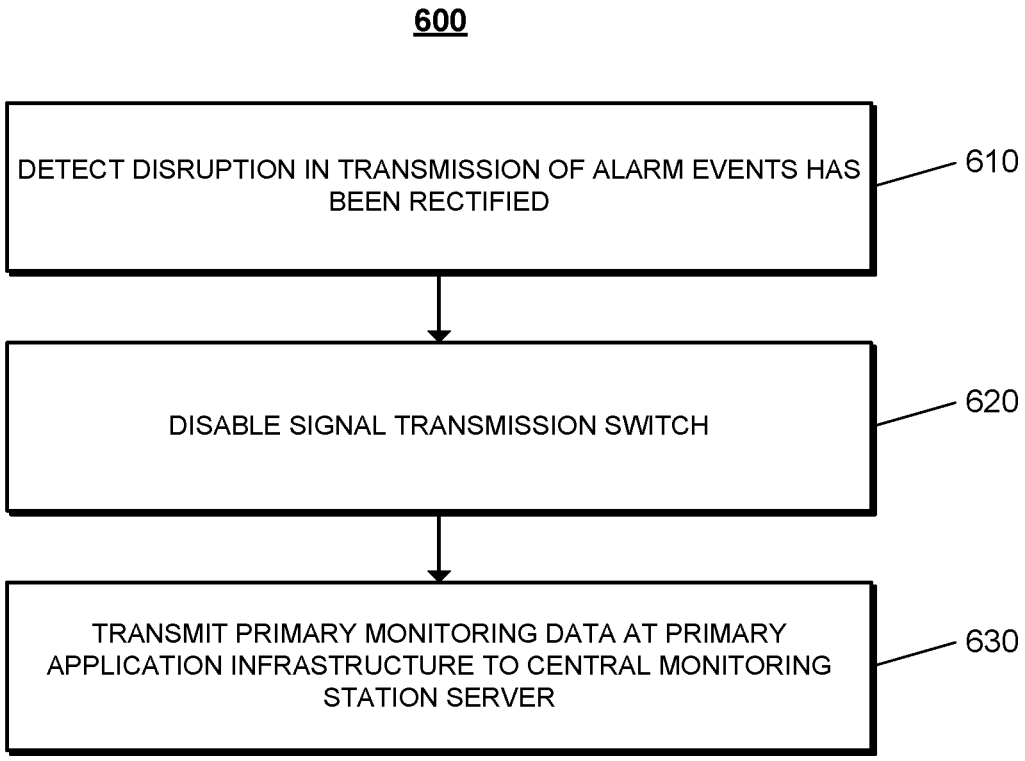
FIG. 6 is a flow diagram of an example process for resuming transmitting alarm events at a primary application infrastructure to a central monitoring station server.

FIG. 6 is a flow diagram of an example process 600 for transmitting alarm events at a primary application infrastructure to the central monitoring station server. The operations of the example process 600 are described generally as being performed by the system 100. The operations of the example process 600 may be performed by one of the components of the system 100 (e.g., one of the primary and secondary application servers 150 and 160) or may be performed by any combination of the components of the system 100 (e.g., a combination of the primary and secondary application servers 150 and 160). In some implementations, operations of the example process 600 may be performed by one or more processors included in one or more electronic devices.

The system detects that the disruption in the ability of the primary application infrastructure to transmit the alarm events detected by the monitoring systems to the central monitoring station server has been rectified (602). For example, the secondary application infrastructure may continue to monitor the activity of the primary application infrastructure and detect when a disruption in the ability of the primary application infrastructure to transmit the alarm events detected by the monitoring systems to the central monitoring station server has been rectified. In some implementations the primary application infrastructure itself may notify one or more components of the monitoring system, e.g., the secondary application infrastructure, when a disruption has been rectified.

Based on the detected rectification, the system disables the signal transmission switch (604). As described above with reference to FIG. 1, the signal transmission switch controls whether monitoring data is transmitted to the central monitoring station server from the primary application infrastructure or the secondary application infrastructure. By disabling the signal transmission switch, monitoring data is transmitted to the central monitoring station server from the primary application infrastructure.

The system transmits alarm events at the primary application infrastructure to the central monitoring station server (606). In some implementations, the system may determine that whilst detecting the rectification of the disruption and disabling the signal transmission switch, all alarm events have been successfully transmitted to the central station server. For example, the system may transmit, by the central monitoring station server and to the secondary application infrastructure, alarm event transmission reports from the primary application infrastructure. The system may compare, by the secondary application infrastructure, the alarm event transmission reports to alarm events stored at the secondary application infrastructure to determine whether the alarm events stored at the secondary application infrastructure were transmitted by the primary application infrastructure. In response to determining that some or all of the alarm events stored at the secondary application infrastructure were not transmitted by the primary application infrastructure, the system may transmit missing alarm events to the central monitoring station server. In some implementations, the transmitted data transmission reports may be used to avoid duplicate transmissions from the primary and secondary application infrastructures.

FIG. 7A illustrates an example data record 700 that stores monitoring data received at a primary application infrastructure. The data record 700 includes a first column 702 for a property ID, a second column 704 for an item ID, a third column 706 for an event, a fourth column 708 for a time stamp, a fifth column 710 for a criticality score and a sixth column 712 for user contact information.

As shown, a first entry 714 in the data record 700 represents monitoring data received at a primary application infrastructure from a monitoring system, e.g., a cloud-based monitoring system, that monitors a property associated with property ID 0028. The first entry 714 represents received monitoring data with item ID 4571 that indicates that an interior motion sensor alarm was triggered at property 0028 on Feb. 3, 2016 at 13:38. The first entry has a criticality score of 0.9, which indicates that the monitoring data is highly critical. For example, a user of the monitoring system at property 0028 may have armed the monitoring system at the property in an "Away" mode from nine in the morning to six in the evening, since all users of the alarm system, e.g., residents of the property, are away from the property during this period of time. Therefore, an unexpected detected motion in the interior of the property at 13:38 may be deemed highly critical and require that appropriate action be taken. For example, the system may transmit some or all of the first entry to a central monitoring station server. In response to the received monitoring data, the central monitoring station server may take action to confirm whether the highly critical interior motion sensor alarm is an actual alarm condition and dispatch emergency personnel to the property 0028. In some examples, the system may notify a user of the monitoring system of the event using associated user contact information 712. For example, a user of the monitoring system at the property may have set a rule demanding that they be immediately notified via telephone of an alarm event with a criticality score above a certain threshold, e.g., 0.75. In other examples, the central monitoring station server may automatically decide to notify a user using the stored user contact information upon dispatching emergency personnel to the property.

A second entry 716 in the data record 700 represents monitoring data received at a primary application infrastructure from a monitoring system, e.g., a cloud-based monitoring system, that monitors a property associated with property ID 1467. The second entry 716 represents received monitoring data with item ID 4752 that indicates that a fire alarm was triggered at property 1467 on Feb. 3, 2016 at 13:32. The second entry has a criticality score of 1.0, which indicates that the monitoring data is extremely critical and requires appropriate action to be taken. For example, the system may transmit some or all of the second entry to a central monitoring station server. In response to the received monitoring data, the central monitoring station server may take action to confirm whether the extremely critical fire alarm is an actual alarm condition and dispatch fire fighter services to the property 1467. The system may notify a user of the monitoring system of the fire alarm using associated user contact information 712, e.g., the provided email address john@smith.com. For example, a user of the monitoring system at the property may have set a rule demanding that they be immediately notified via email of an alarm event with a criticality score above a certain threshold, e.g., 0.75. In other examples, the central monitoring station server may automatically decide to notify a user using the stored user contact information upon dispatching fire fighter services to the property.

A third entry 718 and fourth entry 720 in the data record 700 represents monitoring data received at a primary application infrastructure from a monitoring system, e.g., a cloud-based monitoring system, that monitors a property associated with property ID 0127. The third and fourth entries 718 and 720 represent received monitoring data with item IDs 4753 and 4754 that indicates that a driveway alarm was triggered at property 0127 on Feb. 3, 2016 at 13:33, followed by a front door bell at the property on the same date at 13:35. For example, the monitoring data represented by the third and fourth entries 718 and 720 may be indicative of a postal service attempting to deliver a package. The third and fourth entries each have criticality scores 0.2, which indicates that the monitoring data is not critical.

A fifth entry 722 in the data record 700 represents monitoring data received at a primary application infrastructure from a monitoring system, e.g., a cloud-based monitoring system, that monitors a property associated with property ID 2811. The fifth entry 722 represents received monitoring data with item ID 4755 that indicates that a carbon dioxide alarm was triggered at property 2811 on Feb. 3, 2016 at 15:02. The fifth entry has a criticality score of 0.9, which indicates that the monitoring data is highly critical and requires appropriate action to be taken. For example, the system may transmit some or all of the fifth entry to a central monitoring station server. In response to the received monitoring data, the central monitoring station server may take action to confirm whether the highly critical carbon dioxide alarm is an actual alarm condition and dispatch emergency services to the property 2811. The system may notify a user of the monitoring system of the carbon dioxide alarm using associated user contact information 712, e.g., the provided telephone number (182) 9270-0012. For example, a user of the monitoring system at the property may have set a rule demanding that they be immediately notified via email of an alarm event with a criticality score above a certain threshold, e.g., 0.75. In other examples, the central monitoring station server may automatically decide to notify a user using the stored user contact information upon dispatching emergency services to the property.

FIG. 7B illustrates an example data record 750 that stores monitoring data received at the secondary application infrastructure. The data record 750 includes a first column 752 for a property ID, a second column 754 for an item ID, a third column 756 for an event, a fourth column 758 for a time stamp, a fifth column 760 for a criticality score and a sixth column 762 for user contact information.

As described above with reference to FIG. 1, compared to the primary application infrastructure, which receives all monitoring data generated by the monitoring system, the secondary application infrastructure is configured to only receive critical monitoring information (e.g., life-critical alarm events) through data transmissions from the monitoring system as a secondary resource to the primary application infrastructure. For example, the secondary application infrastructure has a lower data retention than the primary application infrastructure. Therefore, each entry in the data record 750 has a criticality score above a predetermined threshold, e.g., above 0.8.

For example, as described above with reference to FIG. 7A, a first entry 714 in the data record 700 represents received monitoring data with item ID 4751 that indicates that an interior motion sensor alarm was triggered at property 0028 on Feb. 3, 2016 at 13:28. The first entry 714 has a criticality score of 0.9, which indicates that the monitoring data is highly critical. Therefore, the secondary application infrastructure has also received the first entry 714 as a data transmission from the monitoring system as a secondary resource to the primary application infrastructure and has stored the first entry 714 in the data record 750.

Similarly, second entry 716 in the data record 700 represents received monitoring data with item ID 4752 that indicates that a fire alarm was triggered at property 1467 on Feb. 3, 2016 at 13:32. The second entry 716 has a criticality score of 1.0, which indicates that the monitoring data is extremely critical. Therefore, the secondary application infrastructure has also received the second entry 716 as a data transmission from the monitoring system as a secondary resource to the primary application infrastructure and has stored the second entry 716 in the data record 750. Furthermore, fifth entry 722 in the data record 700 represents received monitoring data with item ID 4755 that indicates that a carbon dioxide alarm was triggered at property 2811 on Feb. 3, 2016 at 15:02. The fifth entry 722 has a criticality score of 0.9, which indicates that the monitoring data is highly critical. Therefore, the secondary application infrastructure has also received the fifth entry 722 as a data transmission from the monitoring system as a secondary resource to the primary application infrastructure and has stored the fifth entry 722 in the data record 750.

Figure 8:
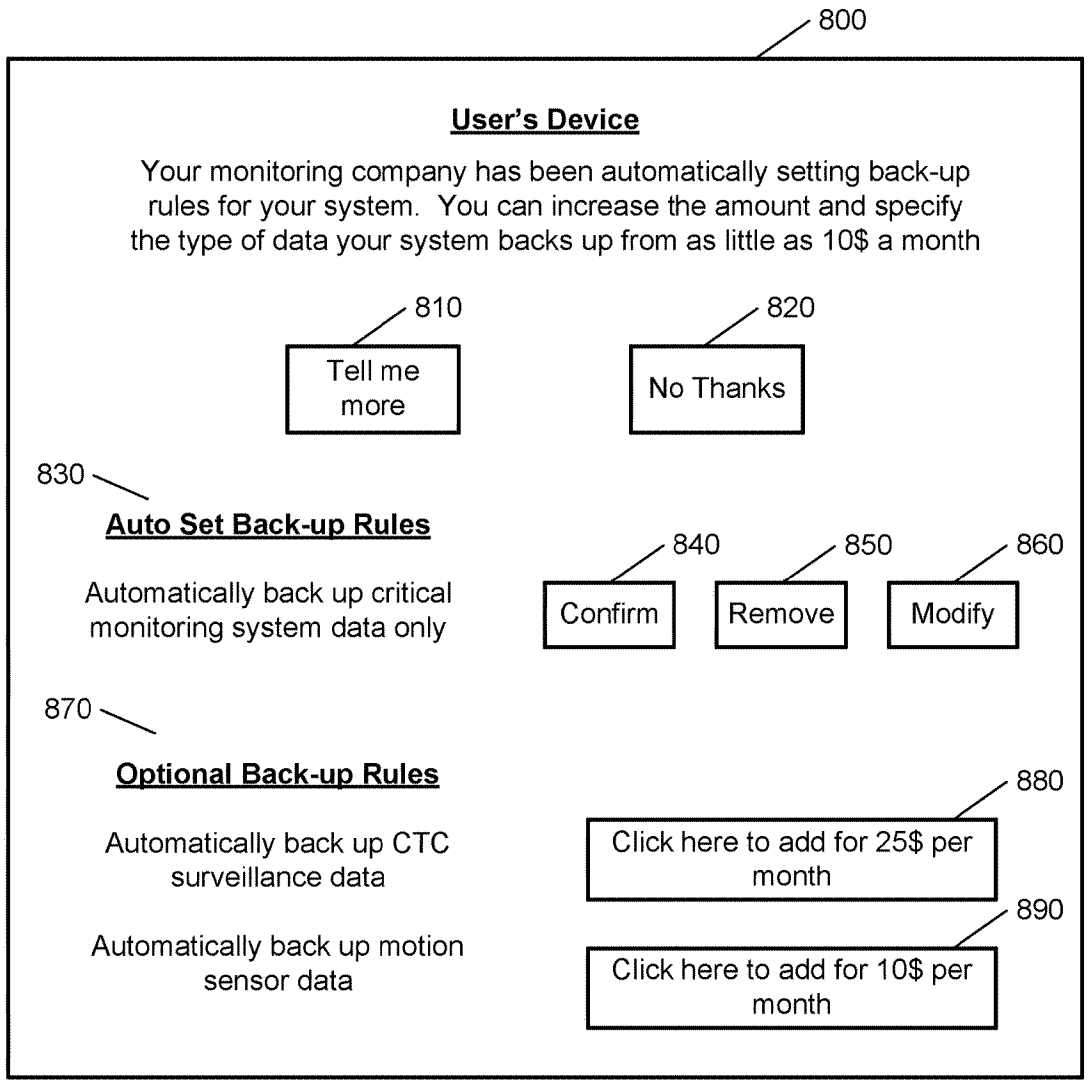
FIG. 8 illustrates an example interface.

FIG. 8 illustrates an example interface 800 that invites a user to specify types of data or amounts of data to be automatically backed-up by a secondary application infrastructure. For example, as described above with reference to FIG. 1 and illustrated in FIGS. 7A and 7B, compared to a primary application infrastructure—which receives all monitoring data generated by a monitoring system—a secondary application infrastructure may be configured to only receive critical monitoring information (e.g., life-critical alarm events) through data transmissions from the monitoring system as a secondary resource to the primary application infrastructure. However, a user may specify alternative settings to enable the secondary application infrastructure to be configured to receive a larger subset of the monitoring data, e.g., all monitoring data. In such cases, the secondary application infrastructure may include a larger data repository to accommodate the increased amount of received data.

The interface 800 may be part of a message (e.g., electronic mail message) sent to a device of a user of a monitoring system or may be displayed when the user of the monitoring system accesses a web page associated with the monitoring system. As shown, the interface 800 includes text informing the user that the monitoring company has been automatically setting back-up rules for monitoring data collected by home monitoring system, and that the user may increase the amount of monitoring data backed-up as well as specifying a type of monitoring data to be backed up. The interface 800 includes a control 810 that may cause display of another interface that provides more details regarding how to increase the amount of data backed up by the system or how to specify the type of data backed up by the system, including associated prices for such an additional service. The interface 800 further includes control 820 that may cause the display of the interface 800 to be minimized or removed.

The interface 800 includes a description of the automatically set back-up rules for the monitoring system 830. The automatically set back-up rules specify that only critical monitoring system data is backed up, e.g., basic information from specific life-threatening alarm events (e.g., fire alarm, carbon monoxide alarm, security breach alarm), such as property identification, contact information for the user, or other information needed to investigate and dispatch emergency services to the property. The interface 800 includes a confirm control 840 that receives input to confirm that the user is satisfied with the automatically set back-up rule. The interface 800 includes a remove control 850 that receives input to remove the automatically set back-up rule. The remove control 850 may cause display of another interface that prompts the user to reconsider removing the automatically set back-up rule. The interface further includes a modify control 860 that may cause display of another interface that enables a user to provide input to modify the automatically set back-up rule by adding and/or changing an amount or type of data to be backed up.

The interface 800 further includes a list of optional/suggested back-up rules 870. A first suggested back-up rule is that the system automatically backs up CTC surveillance data. For example, a user of the monitoring system may have CTC cameras installed at a gate of the property, and may wish that any data recorded by the CTC cameras are backed up. The interface 800 includes a control 880 that may cause display of another interface that provides more details regarding this optional back-up rule and how to subscribe to the optional service. A second back-up rule is that the system automatically backs up motion sensor data. For example, a user of the monitoring system may have motion sensors fitted at a front door of the property, and may wish that any data detected by the motion sensors are backed up. The interface 800 includes a control 890 that may cause display of another interface that provides more details regarding this optional back-up rule and how to subscribe to the optional service. The costs of subscribing to the different levels of automatic back up may vary dependent on the amount and type of data that is to be backed up.

The described systems, methods, and techniques may be implemented in digital electronic circuitry, computer hardware, firmware, software, or in combinations of these elements. Apparatus implementing these techniques can include appropriate input and output devices, a computer processor, and a computer program product tangibly embodied in a machine-readable storage device for execution by a programmable processor. A process implementing these techniques can be performed by a programmable processor executing a program of instructions to perform desired functions by operating on input data and generating appropriate output. The techniques can be implemented in one or more computer programs that are executable on a programmable system including at least one programmable processor coupled to receive data and instructions from, and to transmit data and instructions to, a data storage system, at least one input device, and at least one output device. Each computer program can be implemented in a high-level procedural or object-oriented programming language, or in assembly or machine language if desired; and in any case, the language can be a compiled or interpreted language. Suitable processors include, by way of example, both general and special purpose microprocessors. Generally, a processor will receive instructions and data from a read-only memory and/or a random access memory. Storage devices suitable for tangibly embodying computer program instructions and data include all forms of non-volatile memory, including by way of example semiconductor memory devices, such as Erasable Programmable Read-Only Memory (EPROM), Electrically Erasable Programmable Read-Only Memory (EEPROM), and flash memory devices; magnetic disks such as internal hard disks and removable disks; magneto-optical disks; and Compact Disc Read-Only Memory (CD-ROM). Any of the foregoing can be supplemented by, or incorporated in, specially designed application-specific integrated circuits (ASICs).

It will be understood that various modifications can be made. For example, other useful implementations could be achieved if steps of the disclosed techniques were performed in a different order and/or if components in the disclosed systems were combined in a different manner and/or replaced or supplemented by other components. Accordingly, other implementations are within the scope of the disclosure.

The invention claimed is:

1. A method comprising:

identifying alarm events detected at monitored properties by monitoring systems that are located at the monitored properties and that include at least one sensor within the monitored properties;

tracking the ability of a primary application infrastructure to transmit, to a central monitoring station server, the alarm events detected by the monitoring systems;

detecting disruption in the ability of the primary application infrastructure to transmit the alarm events detected by the monitoring systems to the central monitoring station server;

based on the detected disruption, enabling a signal transmission switch that switches a path for alarm events detected by the monitoring systems from the primary application infrastructure to a secondary application infrastructure, wherein the secondary application infrastructure is an infrastructure operated by a cloud service provider and reconfigurable by a user to store different percentages of the alarm events detected by the monitoring systems; and based on enablement of the transmission switch, transmitting, by the secondary application infrastructure, at least one alarm event detected by the monitoring systems to the central monitoring station server, wherein detecting disruption in the ability of the primary application infrastructure to transmit the alarm events detected by the monitoring systems to the central monitoring station server comprises detecting one or more of (i) a transmission delay in one or more transmission paths for the alarm events between the monitoring systems and the primary application infrastructure, and (ii) that one or more transmissions of the alarm events to the primary application infrastructure is below an expected threshold.

2. The method of claim 1, wherein the secondary application infrastructure is reconfigurable by the user to store only life-critical alarm events.

3. The method of claim 1, wherein detecting disruption in the ability of the primary application infrastructure to transmit the alarm events detected by the monitoring systems to the central monitoring station server comprises:

receiving, at the monitoring systems, acknowledgements from the primary application infrastructure confirming receipt of the alarm events;

determining that one or more acknowledgements from the primary application infrastructure have not been received; and in response to determining that one or more acknowledgements from the primary application infrastructure have not been received, detecting disruption in the ability of the primary application infrastructure to transmit the alarm events detected by the monitoring systems to the central monitoring station server.

4. The method of claim 1, wherein detecting disruption in the ability of the primary application infrastructure to transmit the alarm events detected by the monitoring systems to the central monitoring station server comprises detecting disruption in one or more transmission paths for the alarm events between the monitoring systems and the primary application infrastructure.

5. The method of claim 4, wherein detecting disruption in one or more transmission paths for the alarm events between the monitoring systems and the primary application infrastructure comprises monitoring, by the secondary application infrastructure, the primary application infrastructure.

6. The method of claim 1, wherein detecting that one or more transmissions of the alarm events to the primary application infrastructure is below an expected threshold comprises detecting that one or more transmission of the alarm events is incomplete.

7. The method of claim 4, wherein detecting disruption in one or more transmission paths for the alarm events between the monitoring systems and the primary application infrastructure comprises detecting that a transmission latency of one or more of the alarm events is above an expected threshold.

8. The method of claim 1, wherein detecting disruption in the ability of the primary application infrastructure to transmit the alarm events detected by the monitoring systems to the central monitoring station server comprises detecting disruption at the primary application infrastructure.

9. The method of claim 8, wherein detecting disruption at the primary application infrastructure comprises detecting disruption at the primary application infrastructure by the secondary application infrastructure.

10. The method of claim 9, wherein the secondary application infrastructure monitors data transmitted to a primary signaling application at the primary application infrastructure from the monitoring systems, comprising performing a recursive comparison between alarm events transmitted to the secondary application infrastructure and alarm events simultaneously transmitted to the primary application infrastructure.

11. The method of claim 1, wherein detecting disruption in the ability of the primary application infrastructure to transmit the alarm events detected by the monitoring systems to the central monitoring station server comprises detecting disruption in a transmission path between the primary application infrastructure and the central monitoring station server.

12. The method of claim 1, wherein the signal transmission switch is operated by an operator of the primary application infrastructure, wherein the operator monitors connections between the monitoring systems, primary application infrastructure and the central monitoring station server.

13. The method of claim 1, wherein the signal transmission switch comprises an automated computer-implemented protocol at the central monitoring station server, wherein, in response to the detected disruption, the automated computer-implemented protocol terminates a first access port between the primary application infrastructure and the central monitoring station server and establishes a second access port between the secondary application infrastructure and the central monitoring station server.

14. The method of claim 1, wherein the signal transmission switch comprises a controller, and wherein in response to the detected disruption, the controller initiates, at the central monitoring station server, a failover data transmission process from the secondary application infrastructure, comprising:

receiving, by the central monitoring station server, alarm events from the primary application infrastructure and secondary application infrastructure;

comparing the received alarm events from the primary application infrastructure and the alarm events from the secondary application infrastructure to determine whether the received alarm events from the primary application infrastructure are deficient;

based on determining that the received alarm events from the primary application infrastructure are deficient, initiating, by the central monitoring station server, a file transfer protocol to retrieve a remainder of the alarm events stored on a secondary application infrastructure.

15. The method of claim 1, further comprising:

detecting that the disruption in the ability of the primary application infrastructure to transmit the alarm events detected by the monitoring systems to the central monitoring station server has been rectified;

based on the detected rectification, disabling the signal transmission switch; and transmitting alarm events detected by the monitoring systems from the primary application infrastructure to the central monitoring station server.

16. The method of claim 1, wherein the secondary application infrastructure comprises an application infrastructure with a lower data retention configuration than the primary application infrastructure.

17. The method of claim 16, further comprising:

transmitting, by the central monitoring station server and to the secondary application infrastructure, alarm event transmission reports from the primary application infrastructure;

comparing, by the secondary application infrastructure, the alarm event transmission reports to alarm events stored at the secondary application infrastructure to determine whether the alarm events stored at the secondary application infrastructure were transmitted by the primary application infrastructure; and in response to determining that some or all of the alarm events stored at the secondary application infrastructure were not transmitted by the primary application infrastructure, transmitting missing alarm events to the central monitoring station server.

18. A system comprising:

one or more computers and one or more storage devices storing instructions that are operable, when executed by the one or more computers, to cause the one or more computers to perform operations comprising:

identifying alarm events detected at monitored properties by monitoring systems that are located at the monitored properties and that include at least one sensor within the monitored properties;

tracking the ability of a primary application infrastructure to transmit, to a central monitoring station server, the alarm events detected by the monitoring systems;

detecting disruption in the ability of the primary application infrastructure to transmit the alarm events detected by the monitoring systems to the central monitoring station server;

based on the detected disruption, enabling a signal transmission switch that switches a path for alarm events detected by the monitoring systems from the primary application infrastructure to a secondary application infrastructure, wherein the secondary application infrastructure is an infrastructure operated by a cloud service provider and reconfigurable by a user to store different percentages of the alarm events detected by the monitoring systems; and based on enablement of the transmission switch, transmitting, by the secondary application infrastructure, at least one alarm event detected by the monitoring systems to the central monitoring station server, wherein detecting disruption in the ability of the primary application infrastructure to transmit the alarm events detected by the monitoring systems to the central monitoring station server comprises detecting one or more of (i) a transmission delay in one or more transmission paths for the alarm events between the monitoring systems and the primary application infrastructure, and (ii) that one or more transmissions of the alarm events to the primary application infrastructure is below an expected threshold.

19. A non-transitory computer-readable medium storing software comprising instructions executable by one or more computers which, upon such execution, cause the one or more computers to perform operations comprising:

identifying alarm events detected at monitored properties by monitoring systems that are located at the monitored properties and that include at least one sensor within the monitored properties;

tracking the ability of a primary application infrastructure to transmit, to a central monitoring station server, the alarm events detected by the monitoring systems;

detecting disruption in the ability of the primary application infrastructure to transmit the alarm events detected by the monitoring systems to the central monitoring station server;

based on the detected disruption, enabling a signal transmission switch that switches a path for alarm events detected by the monitoring systems from the primary application infrastructure to a secondary application infrastructure, wherein the secondary application infrastructure is an infrastructure operated by a cloud service provider and reconfigurable by a user to store different percentages of the alarm events detected by the monitoring systems; and based on enablement of the transmission switch, transmitting, by the secondary application infrastructure, at least one alarm event detected by the monitoring systems to the central monitoring station server;

wherein detecting disruption in the ability of the primary application infrastructure to transmit the alarm events detected by the monitoring systems to the central monitoring station server comprises detecting one or more of (i) a transmission delay in one or more transmission paths for the alarm events between the monitoring systems and the primary application infrastructure, and (ii) that one or more transmissions of the alarm events to the primary application infrastructure is below an expected threshold.

20. The method of claim 2, wherein the life-critical alarm events comprise property identification information or contact information the user.

* * * * *